US012544619B2

(12) United States Patent
Petrillo et al.

(10) Patent No.: US 12,544,619 B2
(45) Date of Patent: Feb. 10, 2026

(54) ROWING MACHINE

(71) Applicant: Peloton Interactive, Inc., New York, NY (US)

(72) Inventors: David William Petrillo, Leonia, NJ (US); Rob Rose, Hoboken, NY (US); Julio Liriano, New York, NY (US); Mark Kruse, New York, NY (US); Apostolos Kottas, Brooklyn, NY (US); Nicolas Rozo, Brooklyn, NY (US); Tri Nguyen, Los Gatos, CA (US); Ben McCallum, Brooklyn, NY (US); Adaeze Okoye, Bayonne, NJ (US); Marissa Vivori, New York, NY (US); Betina Evancha, Brooklyn, NY (US); Joseph Intonato, Brooklyn, NY (US); Nicholas Breeser, New York, NY (US); Steven Sanbeg, Piscataway, NJ (US); Kevin Winn, West Islip, NY (US); Rishiraj Digambar Randive, London (GB); Wong Kun Ng, Bergen, NJ (US); Kenneth Jiang, Great Neck, NY (US); Santhosh Mankala, East Greenbush, NY (US); Zhao Li, Jersey City, NJ (US)

(73) Assignee: Peloton Interactive, Inc., New York, NY (US)

( * ) Notice: Subject to any disclaimer, the term of this patent is extended or adjusted under 35 U.S.C. 154(b) by 107 days.

(21) Appl. No.: 18/701,097

(22) PCT Filed: Oct. 12, 2022

(86) PCT No.: PCT/US2022/077979

§ 371 (c)(1),
(2) Date: Apr. 12, 2024

(87) PCT Pub. No.: WO2023/064817

PCT Pub. Date: Apr. 20, 2023

(65) Prior Publication Data

US 2024/0342547 A1 Oct. 17, 2024

Related U.S. Application Data

(60) Provisional application No. 63/331,027, filed on Apr. 14, 2022, provisional application No. 63/254,976, filed on Oct. 12, 2021.

(51) Int. Cl.
*A63B 22/00* (2006.01)
*A63B 71/06* (2006.01)

(52) U.S. Cl.
CPC ..... *A63B 22/0076* (2013.01); *A63B 71/0619* (2013.01); *A63B 2022/0079* (2013.01); *A63B 2071/065* (2013.01); *A63B 2220/833* (2013.01)

(58) Field of Classification Search
CPC ..... A63B 22/0076; A63B 2022/0079; A63B 24/0021; A63B 2024/0028;
(Continued)

(56) References Cited

U.S. PATENT DOCUMENTS

2005/0085348 A1* 4/2005 Kiefer ..... A63B 22/0076 482/72
2009/0154083 A1 6/2009 Katsumata
(Continued)

FOREIGN PATENT DOCUMENTS

KR 200480977 Y1 * 7/2016 ..... A63B 22/0076
WO WO-2013006145 A1 * 1/2013 ..... G09B 19/0038
WO WO-2017008775 A1 * 1/2017 ..... G09B 19/0038

OTHER PUBLICATIONS

International Search Report and Written Opinion dated Feb. 14, 2023 for International Application No. PCT/US2022/077979.

*Primary Examiner* — Gary D Urbiel Goldner
(74) *Attorney, Agent, or Firm* — AMPACC Law Group, PLLC

(57) ABSTRACT

Various systems and methods that enhance an exercise activity performed by a user are described. In some embodiments, a rowing machine is described. The rowing machine includes devices and/or components that can enhance the user experience of a user performing a rowing activity using the rowing machine, such as during a rowing-based exercise
(Continued)

class. For example, the rowing machine can include different sensors that capture information associated with a position or movement of a seat of the rowing machine relative to a position or movement of a handle of the rowing machine and utilize the captured information to perform actions associated with the user performing the rowing activity.

20 Claims, 27 Drawing Sheets

(58) Field of Classification Search
CPC .... A63B 2024/0031; A63B 2024/0034; A63B 71/0619; A63B 71/0622; A63B 2071/065; A63B 2210/50; A63B 2220/13; A63B 2220/30; A63B 2220/31; A63B 2220/40; A63B 2220/80; A63B 2220/833; A63B 2225/09; A63B 2225/682; A63B 2225/685
See application file for complete search history.

(56) References Cited

U.S. PATENT DOCUMENTS

| | | | | |
|---|---|---|---|---|
| 2019/0351283 | A1* | 11/2019 | Smith | A63B 21/0051 |
| 2020/0078635 | A1 | 3/2020 | Smith et al. | |
| 2020/0282256 | A1 | 9/2020 | Boyles et al. | |
| 2020/0376332 | A1 | 12/2020 | Silver | |
| 2023/0115159 | A1* | 4/2023 | Weller | A63B 24/0006 482/72 |

* cited by examiner

ROWING MACHINE

CROSS-REFERENCE TO RELATED APPLICATIONS

This application is a national phase entry of international application No. PCT/US22/77979 filed Oct. 12, 2022, which claims priority to U.S. Provisional Patent Application No. 63/254,976, filed on Oct. 12, 2021, entitled ROWER EXERCISE DEVICE, and U.S. Provisional Patent Application No. 63/331,027, filed on Apr. 14, 2022, entitled USER EXPERIENCE SYSTEMS FOR A ROWING MACHINE, which are hereby incorporated by reference in their entirety.

BACKGROUND

The world of connected fitness is an ever-expanding one. This world can include a user taking part in an activity (e.g., running, cycling, lifting weights, and so on), other users also performing the activity, and other users doing other activities. The users may be utilizing a fitness or exercise machine (e.g., a treadmill, a stationary bike, a strength machine, a stationary rower, and so on), or may be moving through the world on a bicycle or other machine.

An exercise machine, such as a rower, can include a display device or display that includes a user interface providing or presenting interactive content to the users. For example, the user interface can present live or recorded classes, video tutorials of activities, online or interactive games, augmented reality environments, leaderboards and other competitive or interactive features, progress indicators (e.g., via time, distance, and other metrics), and so on.

BRIEF DESCRIPTION OF THE DRAWINGS

Embodiments of the present technology will be described and explained through the use of the accompanying drawings.

Figure 1:
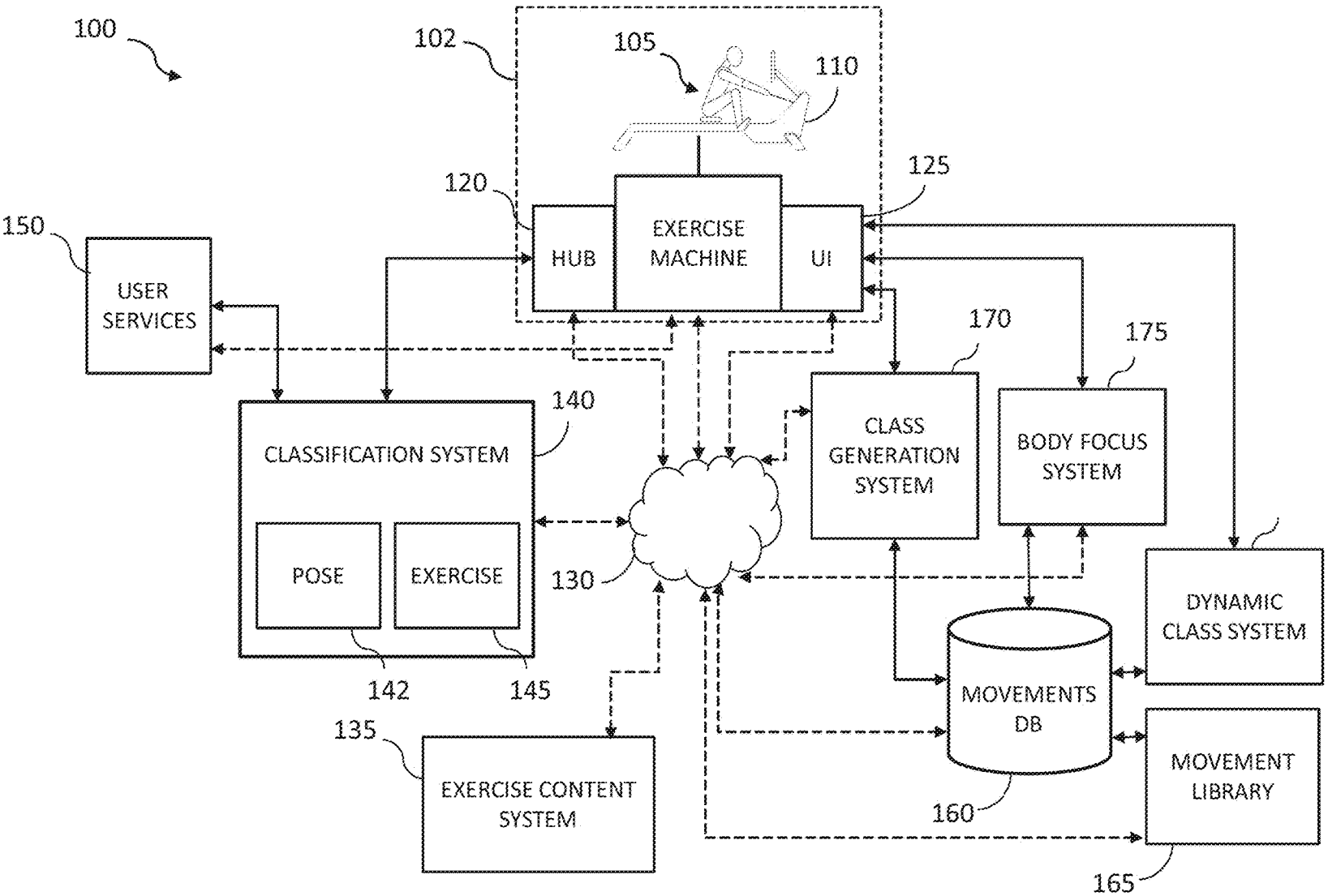
FIG. 1 is a block diagram illustrating a suitable network environment for users of a connected fitness platform.

In the drawings, some components are not drawn to scale, and some components and/or operations can be separated into different blocks or combined into a single block for discussion of some of the implementations of the present technology. Moreover, while the technology is amenable to various modifications and alternative forms, specific implementations have been shown by way of example in the drawings and are described in detail below. The intention, however, is not to limit the technology to the particular implementations described. On the contrary, the technology is intended to cover all modifications, equivalents, and alternatives falling within the scope of the technology as defined by the appended claims.

Overview

Various systems and methods that enhance an exercise activity performed by a user are described. In some embodiments, a rowing machine is described. The rowing machine includes devices and/or components that can enhance the experience of a user performing a rowing activity via the rowing machine, such as during a rowing-based exercise class.

In some embodiments, the rowing machine can include features that facilitate tracking or measuring the rowing movements or activities performed by the user during the class (or during another interactive session or activity). For example, the rowing machine can include different sensors that capture information associated with a position or movement of a seat of the rowing machine relative to a position or movement of a handle of the rowing machine and utilize the captured information to perform actions associated with the user performing the rowing activity.

These actions can include identifying a part of a stroke performed by the user, detecting errors or issues with a current form of the user during the rowing activity, tracking the movement of the user during the rowing activity, rendering a visualization (e.g., a displayed avatar) of the user during the rowing activity, and so on.

Further, the rowing machine can include components that facilitate easy operation and use of the rowing machine by one or multiple users (e.g., a household or group of users). For example, the rowing machine can include foot stretchers having an enhanced foot coupling mechanism, a display mount that facilitates the swiveling and folding of a display of the machine, storage components disposed or placed proximate to a user, and components that facilitate moving and stowing the rowing machine in an upright, secured orientation, among other features.

Various embodiments of the rowing machine, including associated systems and methods, will now be described. The following description provides specific details for a thorough understanding and an enabling description of these embodiments. One skilled in the art will understand, however, that these embodiments may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments.

Examples of a Suitable Exercise Platform

The technology described herein is directed, in some embodiments, to providing a user with an enhanced user experience when performing an exercise activity, such as an exercise activity as part of a connected fitness system or other exercise system. For example, a user (e.g., a member of a connected fitness platform) can perform a rowing activity via a rowing machine, such as a stationary rower having an electromechanical or magnetic drivetrain, as described herein.

FIG. 1 is a block diagram illustrating a suitable network environment 100 for users of an exercise system. The network environment 100 includes an activity environment 102, where a user 105 is performing an exercise activity, such as a rowing activity. In some cases, the user 105 can perform the rowing activity with an exercise machine 110, which can be a stationary rower or rowing machine.

In addition, the user 105 can perform other exercise activities, including a variety of different workouts, activities, actions, and/or movements, such as movements associated with stretching, doing yoga, lifting weights, rowing, running, cycling, jumping, sports movements (e.g., throwing a ball, pitching a ball, hitting, swinging a racket, swinging a golf club, kicking a ball, hitting a puck), and so on.

The exercise machine 110 can assist or facilitate the user 105 to perform the movements and/or can present interactive content to the user 105 when the user 105 performs the activity. For example, in some cases, the exercise machine 110 can be a stationary bicycle, a treadmill, a weight machine, or other machines. As another example, the exercise machine 110 can be a display device that presents content (e.g., classes, dynamically changing video, audio, video games, instructional content, and so on) to the user 105 during an activity or workout.

The exercise machine 110 includes a media hub 120 and a user interface 125. The media hub 120, in some cases, captures images and/or video of the user 105, such as images of the user 105 performing different movements, or poses, during an activity. The media hub 120 can include a camera or cameras, a camera sensor or sensors, or other optical sensors configured to capture the images or video of the user 105.

In some cases, the media hub 120 can capture audio (e.g., voice commands) from the user 105. The media hub 120 can include a microphone or other audio capture devices, which captures the voice commands spoken by a user during a class or other activity. The media hub 120 can utilize the voice commands to control operation of the class (e.g., pause a class, go back in a class), to facilitate user interactions (e.g., a user can vocally "high five" another user), and so on.

In some cases, the media hub 120 includes components configured to present or display information to the user 105. For example, the media hub 120 can be part of a set-top box or other similar device that outputs signals to a display, such as the user interface 125. Thus, the media hub 120 can operate to both capture images of the user 105 during an activity, while also presenting content (e.g., streamed classes, workout statistics, and so on) to the user 105 during the activity.

The user interface 125 provides the user 105 with an interactive experience during the activity. For example, the user interface 125 can present user-selectable options that identify live classes available to the user 105, pre-recorded classes available to the user 105, historical activity information for the user 105, progress information for the user 105, instructional or tutorial information for the user 105, and other content (e.g., video, audio, images, text, and so on), that is associated with the user 105 and/or activities performed (or to be performed) by the user 105.

The exercise machine 110, the media hub 120, and/or the user interface 125 can send or receive information over a network 130, such as a wireless network. Thus, in some cases, the user interface 125 is a display device (e.g., attached to the exercise machine 110), that receives content from (and sends information, such as user selections) an exercise content system 135 over the network 130. In other cases, the media hub 120 controls the communication of content to/from the exercise content system 135 over the network 130 and presents the content to the user via the user interface 125.

The exercise content system 135, located at one or more servers remote from the user 105, can include various content libraries (e.g., classes, movements, tutorials, games, virtual environments, and so on) and perform functions to stream or otherwise send content to the machine 110, the media hub 120, and/or the user interface 125 over the network 130.

In addition to a machine-mounted display, the display device 125, in some embodiments, can be a mobile device associated with the user 105. Thus, when the user 105 is performing activities outside of the activity environment 102 (such as running, climbing, and so on), a mobile device (e.g., smart phone, smart watch, or other wearable device), can present content to the user 105 and/or otherwise provide the interactive experience during the activities.

In some embodiments, a classification system 140 communicates with the media hub 120 to receive images and perform various methods for classifying or detecting poses, motions, and/or exercises performed by the user 105 during an activity. The classification system 140 can be remote from the media hub 120 (as shown in FIG. 1) or can be part of the media hub 120.

The classification system 140 can include a pose detection system 142 that detects, identifies, and/or classifies poses performed by the user 105 and depicted in one or more images captured by the media hub 120. Further, the classification system 140 can include an exercise detection system 145 that detects, identifies, and/or classifies exercises or movements performed by the user 105 (e.g., different parts of a rowing stroke) and depicted in the one or more images captured by the media hub 120.

Various systems, applications, and/or user services 150 provided to the user 105 can utilize or implement the output of the classification system 140 and/or data collected by the exercise machine 110, as described herein.

In some embodiments, the systems and methods include a movements database (dB) 160. The movements database 160, which can reside on a content management system (CMS) or other system associated with the exercise platform (e.g., the exercise content system 135), stores information as entries that relate individual movements to data associated with the individual movements. As is described herein, a movement is a unit of a workout or activity, and in some cases, the smallest unit of the workout or activity. Example movements include a push-up or a jumping jack or a bicep curl or portion of a rowing stroke.

The movements database 160 can include, or be associated with, a movement library 165. The movement library 165 includes short videos (e.g., GIFs) and long videos (e.g., ~90 seconds or longer) of movements, exercises, activities, and so on. Thus, in one example, the movements database 160 can relate a movement to a video or GIF within the movement library 165.

Various systems and applications can utilize information stored by the movements database 160. For example, a class generation system 170 can utilize information from the movements database 160 when generating, selecting, and/or recommending classes for the user 105, such as classes that target specific muscle groups.

As another example, a body focus system 175 can utilize information stored by the movements database 160 when presenting information to the user 105 that identifies how a certain class or activity strengthens or works the muscles of their body. The body focus system 175 can present interactive content that highlights certain muscle groups, displays changes to muscle groups over time, tracks the progress of the user 105, and so on.

Further, a dynamic class system 180 can utilize information stored by the movements database 160 when dynamically generating a class or classes for the user 105. For example, the dynamic class system 180 can access information for the user 105 from the body focus system 175 and determine one or more muscles to target in a new class for the user 105. The system 180 can access the movements database 160 using movements associated with the targeted muscles and dynamically generate a new class for the user that incorporates videos and other content identified by the database 160 as being associated with the movements.

FIG. 1 and the components, systems, servers, and devices depicted herein provide a general computing environment and network within which the technology described herein can be implemented. Further, the systems, methods, and techniques introduced here can be implemented as special-purpose hardware (for example, circuitry), as programmable circuitry appropriately programmed with software and/or firmware, or as a combination of special-purpose and programmable circuitry. Hence, implementations can include a machine-readable medium having stored thereon instructions which can be used to program a computer (or other electronic devices) to perform a process. The machine-readable medium can include, but is not limited to, floppy diskettes, optical discs, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other types of media/machine-readable medium suitable for storing electronic instructions.

The network or cloud 130 can be any network, ranging from a wired or wireless local area network (LAN), to a wired or wireless wide area network (WAN), to the Internet or some other public or private network, to a cellular (e.g., 4G, LTE, or 5G network), and so on. While the connections between the various devices and the network 130 and are shown as separate connections, these connections can be any kind of local, wide area, wired, or wireless network, public or private.

Further, any or all components depicted in the Figures described herein can be supported and/or implemented via one or more computing systems or servers. Although not required, aspects of the various components or systems are described in the general context of computer-executable instructions, such as routines executed by a general-purpose computer, e.g., mobile device, a server computer, or personal computer. The system can be practiced with other communications, data processing, or computer system configurations, including: Internet appliances, hand-held devices, wearable devices, or mobile devices (e.g., smart phones, tablets, laptops, smart watches), all manner of cellular or mobile phones, multi-processor systems, microprocessor-based or programmable consumer electronics, set-top boxes, network PCs, mini-computers, mainframe computers, AR/VR devices, gaming devices, and the like. Indeed, the terms "computer," "host," and "host computer," and "mobile device" and "handset" are generally used interchangeably herein and refer to any of the above devices and systems, as well as any data processor.

Aspects of the system can be embodied in a special purpose computing device or data processor that is specifically programmed, configured, or constructed to perform one or more of the computer-executable instructions explained in detail herein. Aspects of the system may also be practiced in distributed computing environments where tasks or modules are performed by remote processing devices, which are linked through a communications network, such as a Local Area Network (LAN), Wide Area Network (WAN), or the Internet. In a distributed computing environment, program modules may be located in both local and remote memory storage devices.

Aspects of the system may be stored or distributed on computer-readable media (e.g., physical and/or tangible non-transitory computer-readable storage media), including magnetically or optically readable computer discs, hard-wired or preprogrammed chips (e.g., EEPROM semiconductor chips), nanotechnology memory, or other data storage media. Indeed, computer implemented instructions, data structures, screen displays, and other data under aspects of the system may be distributed over the Internet or over other networks (including wireless networks), or they may be provided on any analog or digital network (packet switched, circuit switched, or other scheme). Portions of the system may reside on a server computer, while corresponding portions may reside on a client computer such as an exercise machine, display device, or mobile or portable device, and thus, while certain hardware platforms are described herein, aspects of the system are equally applicable to nodes on a network. In some cases, the mobile device or portable device may represent the server portion, while the server may represent the client portion.

Examples of a Rowing Machine

Figure 2A:
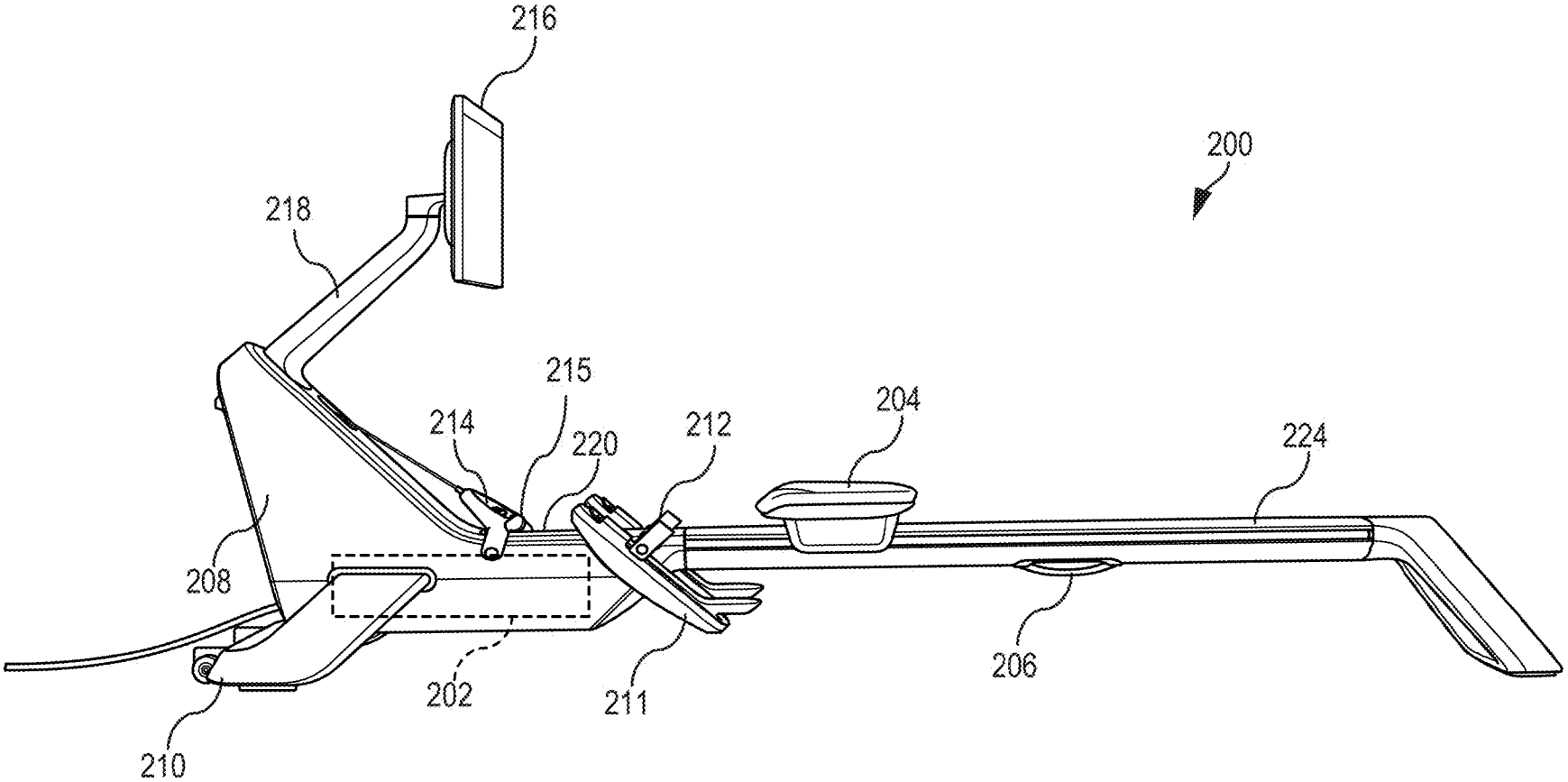
FIGS. 2A-2B are diagrams illustrating an example rowing machine.

FIG. 2A depicts an example rowing machine 200, such as an exercise machine that simulates or supports a user performing a rowing activity on a boat or other water-based vehicle.

The rowing machine 200 includes a drivetrain 202, a seat 104, a rail handle 206, a hub 208 or housing, hub stabilizer wheels 210, a foot stretcher 211 (e.g., a pair of foot stretchers), a foot binding component 212, a handle 214, a handle mount 215, a display 216, a display mount 218, a storage compartment 220, and a rail 224 that extends out of the hub 208 upon which the seat 204 moves back and forth.

In some cases, the drivetrain 202, which is at least partially contained by the hub 208, positions a user in a rowing position, and may be parallel or substantially parallel to a horizontal surface, such as a floor. The drivetrain 202 can include a power absorber and electronic controls. Further, the drivetrain 202 can include or provide magnetic damping (e.g., providing quiet operation), a mechanically adjustable drag factor, and/or a software adjustable drag factor, which causes a user (e.g., the user 105) to feel a simulated rowing experience when pulling and/or holding the handle 214 during a rowing activity.

The drivetrain 202 can include a flywheel or other rotating mass, such as a steel disc or wheel. In some cases, the drivetrain 202 can include a belt tensioner and/or be hydro driven. Thus, in some cases, the drivetrain 202 operates to convert linear movement of the handle 214 (coupled to the drivetrain 202 via a strap or rope) to rotary motion of a rotating device (e.g., flywheel or other rotating mass) of the drivetrain 202.

The rail 224 (or rails) can be part of the drivetrain 202, coupled to the drivetrain 202 or the hub 208, and/or positioned proximate to the drivetrain 202 or the hub 208. In some cases, the drivetrain 202 and/or the rails 224 may be detachable from the hub 208 for transport, storage, or other factors.

In some cases, the seat 204 attaches to the rail 224. The seat 204 slides horizontally on top of the rail 224 (e.g., along the rail 224) during a rowing activity performed by a user. For example, the user can apply a force when they begin rowing (e.g., the user pushes off with their feet to move away from the hub 208 or pulls back to move back towards the hub 208). The seat 204 can be ergonomic and stable.

Further, the seat 204 can include a position lock (e.g., a rotating lever and a rubber bumper) that locks the seat 204 to the rail 224 (e.g., when the rowing machine 200 is being stowed or moved). The seat 204 can also be set to an over-center or detent stop position, and can include spring-to-open feature, where the user can slide the lever from one side to the other to lock or unlock the seat 204 or saddle at any position along the rail 224.

The rail handle 206 is attached to a bottom portion of the rail 224, such as at a rear area of the rail 224 (near the rear end of the rowing machine 200). In some cases, the rail handle 206 is curved, such that the end of the rail handle 206 may connect to the bottom or side of the rail 224 to form an opening between the rail handle 206 and the rail 224. In some cases, the rail handle 206 assists in transporting the rowing machine 200 from one location to another and/or to lift (e.g., pivot) the rowing machine 200 to a vertical orientation.

Thus, the rail handle 206 is positioned near the rear end of the rail 224 to provide a user with leverage when lifting the rear end of the rail 224 upwards to orient the rowing machine 200 vertically place or to storage. As is described herein, the rowing machine 200 can be positioned in the vertical or upright orientation and fixed to a wall or other vertical surface.

In some cases, the hub 208, or housing, (at least partially) contains the drivetrain 202 or is otherwise positioned proximate to the drivetrain 202. The hub 208 can support the display 216 via the display mount 218 and can be detachable from the rail 224 or display 216. The hub 208 can be formed of a certain geometry and/or weight (relative to the entire machine 200) such that the hub 208 provides a stable base when the rowing machine 200 is positioned or oriented vertically. Further stabilizer wheels 210 (attached to feet) can assist in moving and/or lifting the rowing machine 200, as well as stabilizing the machine 200 when upright.

The foot stretcher 211 is configured to secure the feet of a user during a rowing activity. For example, the foot stretcher 211 can be a pair of stretchers and is disposed near the front of the rail 224. As described herein, the foot stretcher 211 can include a spring-loaded mechanism that facilitates a one-handed adjustment of each stretcher when the user inserts/removes a foot into/from the stretcher. The foot stretcher 211 includes a foot binder 212 to secure the foot in place.

The handle 214 is coupled or connected to the drivetrain 202 and/or hub 208 via a cable, rope, strap, or other physical connection. The handle dock 215 is configured to dock the handle 215 when not in use and/or to reset tracking/monitoring of a rowing activity when the handle 214 is docked or otherwise proximate to the handle dock 215.

As is described herein, the handle 214 can include communication components, user controls, charging components, and so on. For example, the handle 214 can include components that interact with pogo pins of the handle dock 215 and/or a hall effect sensor of the handle dock 215, to charge the handle 214 and/or detect the proximity of the handle 214. Further, the handle 214 can include integrated controls that facilitate user navigation of content displayed by the display 216, adjustment of operation characteristics of the rowing machine 200 (e.g., an applied damping factor), and so on.

The display 216 is supported by the display mount 218, which attaches the display 216 to the hub 208 or housing. The display 216 can be a computing device that provides a user interface, such as tablet with a modular touch screen display. In some cases, the rowing machine 200 is associated with a portable computing device that provides a user interface, such as a smartphone, a watch, another display, a television, and so on.

As described herein, the display mount 218 can be a swivel mount that swivels up and down, and side to side up to a predefined number of degrees, such as 45 degrees. The display mount 218 can attach or support the display 216 on one end and attach to the hub 208 at the other end. In some cases, the display mount 218 includes a folding mechanism that facilitates the folding of the display 216 to a certain number of degrees (e.g., towards the rail 224) during storage, transport, set-up, and other functions when not in use for a rowing activity.

The storage compartment 120 is disposed near a front end of the rail 224 and proximate to the drivetrain 202 or hub 208, such as (at least partially) between the two stretchers of the foot stretcher 221. The storage compartment can include compartments for storing various items or tools, such as compartments having a shape or geometry to store or receive a water bottle, a towel, and/or a mobile device. The storage compartment 120 can also include a charging mechanism or port (e.g., a USB port or an inductive charging platform) for charging the mobile device.

Figure 2B:
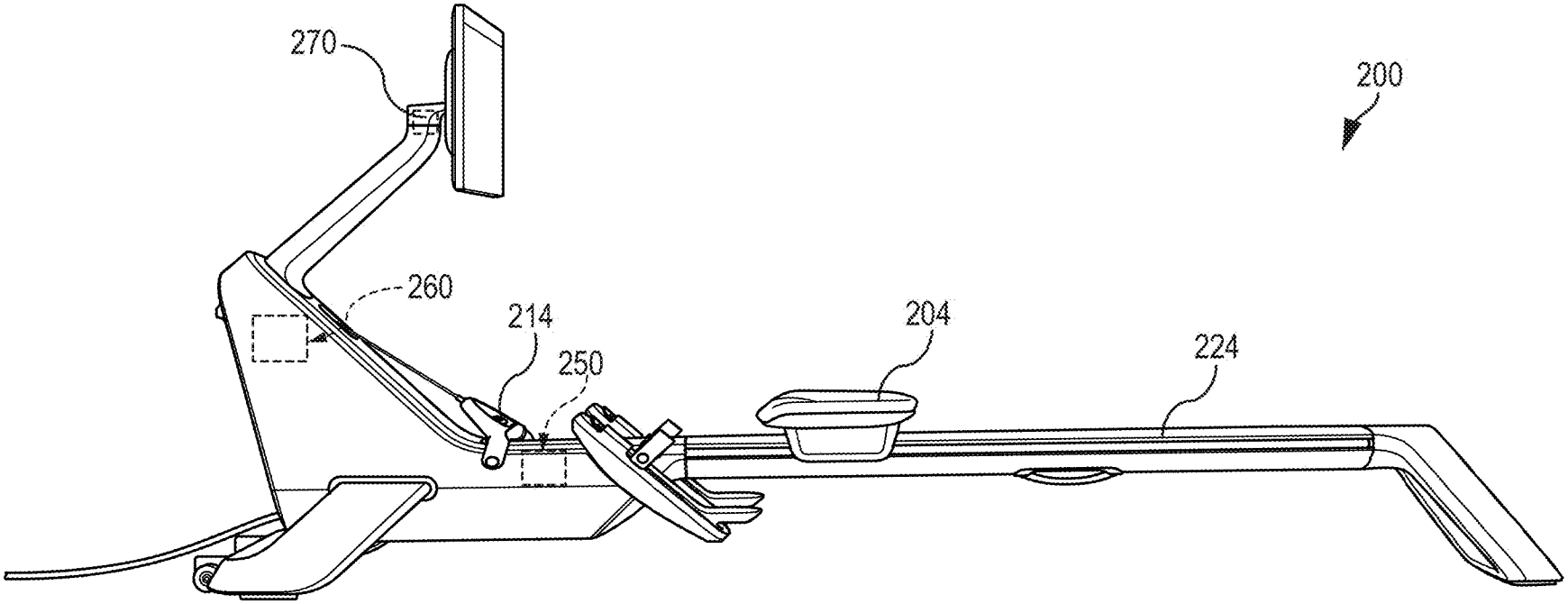

FIG. 2B depicts various sensors of the rowing machine 200. The rowing machine 200 can include a seat sensor 250 and a handle sensor 260. In some embodiments, the rowing machine 200 (e.g., the hub 208 or the display 216) includes a form system 270, which can include various modules configured to perform actions based on input received from the sensors 250, 260.

In some embodiments, the form system 270 can receive information (e.g., position information) captured by the seat sensor 250 and/or the handle sensor 260, and determine a current form, or error in the form, of a user of the rowing machine 200 during one or more phases of a rowing stroke.

In some cases, the seat sensor 250 is a time-of-flight (ToF) sensor or camera that aims a laser or LED light signal along a rail (e.g., the rail 224) of the rowing machine 200 to the seat 204 to determine the position/velocity/acceleration of the seat 204 (along the rail 224) based on a time or duration of the light signal to travel to the seat 204 and reflect to the seat sensor 250.

In some cases, the handle sensor 260 is an encoder that measures a position/velocity/acceleration for the handle 214 based on a position or velocity or acceleration of a motor (e.g., the drivetrain 202) or rotating mass coupled via a cable to the handle 214. The motor or mass rotates as the handle 214 is pulled and released by the user, as described herein.

Thus, the form system 270 can be associated with a sensor system that includes the handle sensor 260 (e.g., an encoder), which tracks movement of the handle as the user performs different rowing movements (e.g., the catch, the drive, the finish, the recovery) and the seat sensor 250 (e.g., a ToF sensor) that tracks movement of the seat 204. The form system 270 can utilize information from sensor system to determine whether the relative movement of the handle and the seat (e.g., the relative positions or velocities or accelerations at any given time or duration during a rowing movement) represent good or bad form for the user, among other determinations.

In some cases, the rowing machine 200 can include a camera or other image sensors that capture images of the user during rowing movements. The system can utilize the images to identify certain features of the user during a stroke, such as the curvature of a user's back, distances between different points on the user (e.g., between the eyes and shoulders of the user), and so on. The system can employ the relative position information and/or the imaging information with machine learning algorithms to generate predictions about the user's form, form errors, and so on. The camera or image sensors can be disposed within the display 216, the hub 208, the display mount 218, or other locations suitable for imaging the user during rowing activities.

In some embodiments, other sensors can be distributed throughout the rowing machine 200 or be communicatively coupled to the rowing machine 200 or the display 216. For example, one or more sensors may be located inside or on the surface of the seat 204, the handle 214, the foot stretcher 211, the rail 224, and so on.

The group of sensors can include sensors that monitor or measure activity data, such as the simulated speed, cadence, and so on, of the rowing machine 200, capture video or images of the user using the rowing machine 200, measure user performance data, and/or measure user characteristics (e.g., a heart rate, respiration, hydration levels, and so on). The sensors may transmit the data to the rowing machine 200 (e.g., to the display 216), to other devices or machines, and/or to one or more servers or systems using wired or wireless connections, such as Bluetooth, HiD Remote, BLE HRM, Wi-Fi, and/or the Internet.

As described herein, the sensors can measure, track, or capture activity data of the user during a rowing activity performed via the rowing machine 200. In some cases, the various sensors are calibrated to accurately measure the activity data, such as based on usage or diagnostic information for the rowing machine 200 and/or a group of rowing machines associated with the connected fitness platform 100. Any of the sensors can include components programmed to generate error status and error codes when the sensors detect an error, and activity data, error status and/or error codes can be logged into a logging application included in the sensor and/or the rowing machine 200.

Thus, in some embodiments, the rowing machine 200 can include a drivetrain, a handle that is coupled to the drivetrain, a seat that moves along a rail, and a sensor system, including a seat sensor that is configured to detect a position of the seat along the rail and a handle sensor that is configured to detect a position of the handle. In some cases, the seat sensor is a ToF sensor disposed on a rail and captures distance information for the seat as the seat moves along the rail and the handle sensor is an encoder that captures rotation information for a flywheel, motor, or rotating mass of a drivetrain. The sensor system can transmit or send data to a user form system, which determines a form of a user performing a rowing activity via the rowing machine based on the detected position of the seat along the rail in relation to the detected position of the handle.

Examples of Performing Actions Associated with a Rowing Machine

Figure 3A:
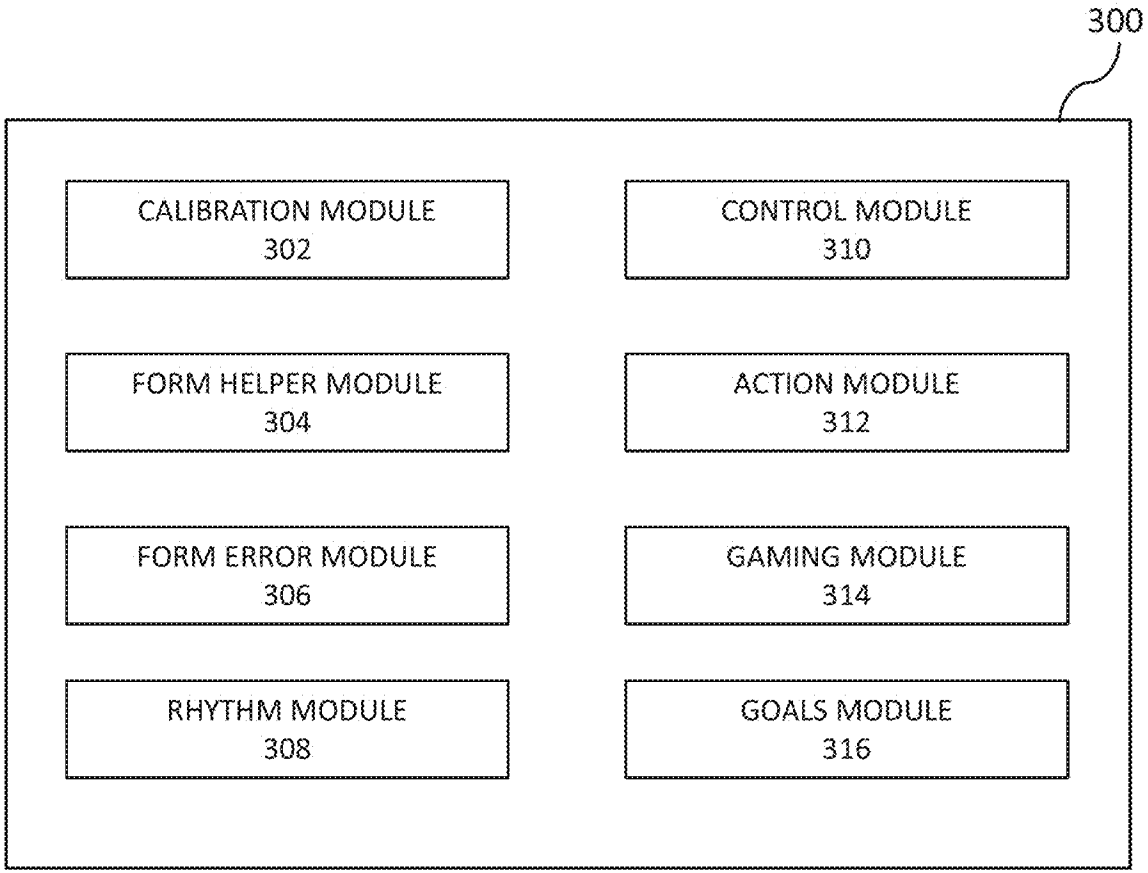
FIG. 3A is a block diagram illustrating components of a rowing machine.

As described herein, in some embodiments, various systems or modules can perform actions based on information captured by the rowing machine 200 during a rowing activity of a user. FIG. 3A is a block diagram 300 illustrating various action modules of the rowing machine 200.

The modules of the rowing machine 200 can be implemented with a combination of software (e.g., executable instructions, or computer code) and hardware (e.g., at least a memory and processor). Accordingly, as used herein, in some example embodiments, a component/module is a processor-implemented component/module and represents a computing device having a processor that is at least temporarily configured and/or programmed by executable instructions stored in memory to perform one or more of the functions that are described herein.

In some embodiments, a personalized device calibration module 302 is configured and/or programmed to receive and process user input associated with the position data for user catch and finish positions. The personalized device calibration module 302 may store position data received from one or more sensors of the rowing machine 200 and can save the position data and other sensor measurements to a user profile for a user (e.g., rower) of the rowing machine 200.

In some embodiments, a form helper module 304 is configured and/or programmed to provide real-time feedback as a visualization of an avatar or other animation via the display 216. The real-time feedback can be based on a comparison of data from the seat and handle sensors with data associated with a known or proper form provided by a software algorithm and based on what is an optimal or suitable handle and seat position data for the user. For example, the proper form can be a form that results in a low amount of impact on the body during a workout. The form helper module 304 can cause the display 216 to present a visualization of how a user's current or recorded form deviates from the proper rowing form for the user.

In some embodiments, a form error module 306 is configured and/or programmed to provide real-time error classification of common rowing errors (e.g., the different parts if a stroke as described herein) based on user-calibrated values determined via a software algorithm. The errors can be based on handle and seat position data from the sensors.

In some embodiments, a rhythm module 308 is configured and/or programmed to provide a visual indication of a stroke output during a rowing activity based on a measured power of the user for each performed stroke. For example, the rhythm module 308 can receive sensor data that captures the rowing activity and generate or render a visualization that dynamically changes along with the movement of the user during the rowing activity.

In some embodiments, a control module 310 is configured and/or programmed to implement and perform a closed loop forward control system to control damping of the drivetrain 202, such as damping that applies a variable or constant damping factor to the drivetrain 202 during a rowing activity.

In some embodiments, a class module 312 is configured and/or programmed to enable responses or input to in-class events, such as via input received from a user via the handle 214 during the rowing activity.

In some embodiments, a gaming module 314 is configured and/or programmed to provide or present game-based rowing experiences via the display 216.

In some embodiments, a goals module 216 is configured and/or programmed to provide or present a user interface that displays information for a user, such as workout history information that compares workouts across different goals or events (e.g., a 2000-meter workout, 5000-meter workout, and so on).

Figure 3B:
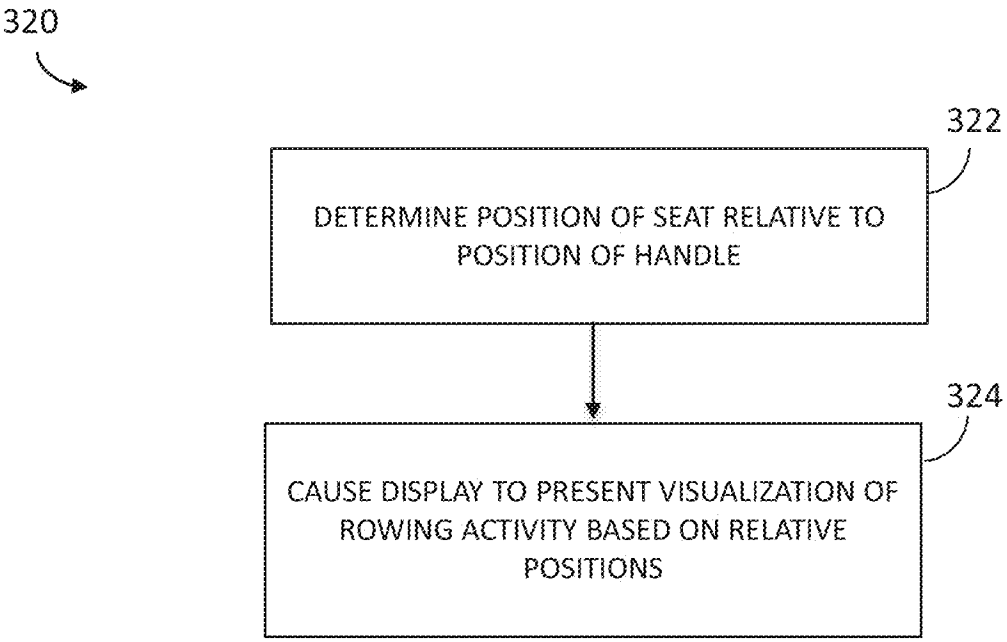
FIG. 3B is a flow diagram illustrating an example method for performing an action using rowing machine data.

As described herein, the form system or one or more of the action modules described herein can utilize data captured by sensors of the rowing machine 200 and perform actions using or based on the captured data. FIG. 3B is a flow diagram illustrating an example method 320 for performing an action using rowing machine data. The method 320 may be performed by the form system 270 or other action modules and, accordingly, is described herein merely by way of reference thereto. It will be appreciated that the method 320 may be performed on any suitable hardware.

In operation 322, the form system 270 determines a position of a seat relative to a position of a handle. For example, the form system 270 can receive data from the seat sensor 250, which is associated with a position of the seat 204 along the rail 224 and the handle sensor 260, which is associated with a position of the handle 214.

In operation 324, the form system 270 causes a display to present a visualization of the rowing activity based on the relative positions of the seat and handle. For example, the form system 270 causes the display 216 to present an avatar of the user rowing and/or a form helper visualization that depicts and/or identifies certain areas on a user that are compromised or causing form errors during the rowing activity.

Figure 3D:
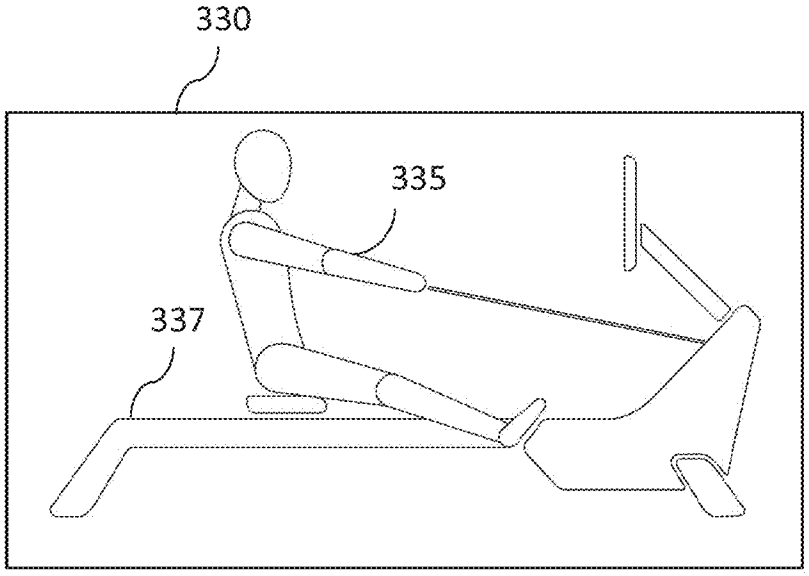
FIGS. 3C-3D depict a visualization of an avatar representing a user on a rowing machine.
Figure 3C:
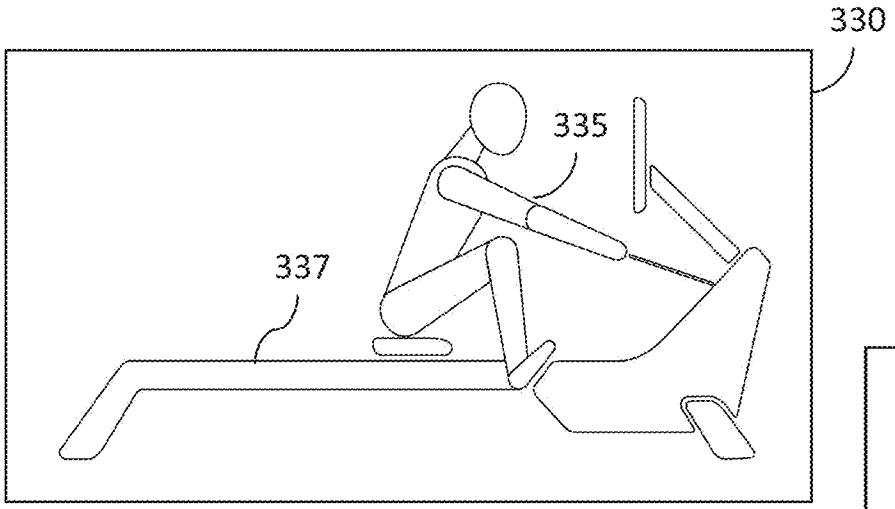
Figure 3E:
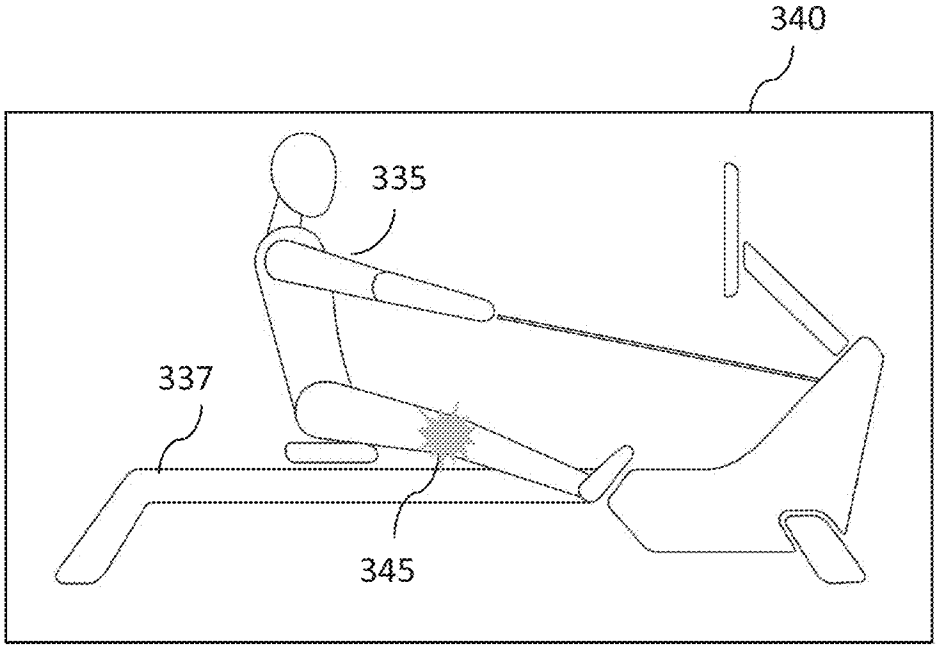
FIG. 3E depicts a visualization that identifies a form error for a user.

As one example, FIGS. 3C-3D depict a visualization 330 of an avatar 335 representing a user on a rowing machine 337. The visualization 330 is rendered by the form system 270 and moves in sync with the user as the user performs a rowing activity via the rowing machine 200. As another example, FIG. 3E depicts a visualization 340 that identifies a form error 345 for the user via the avatar 335.

Examples of a Handle for a Rowing Machine

Figure 4:
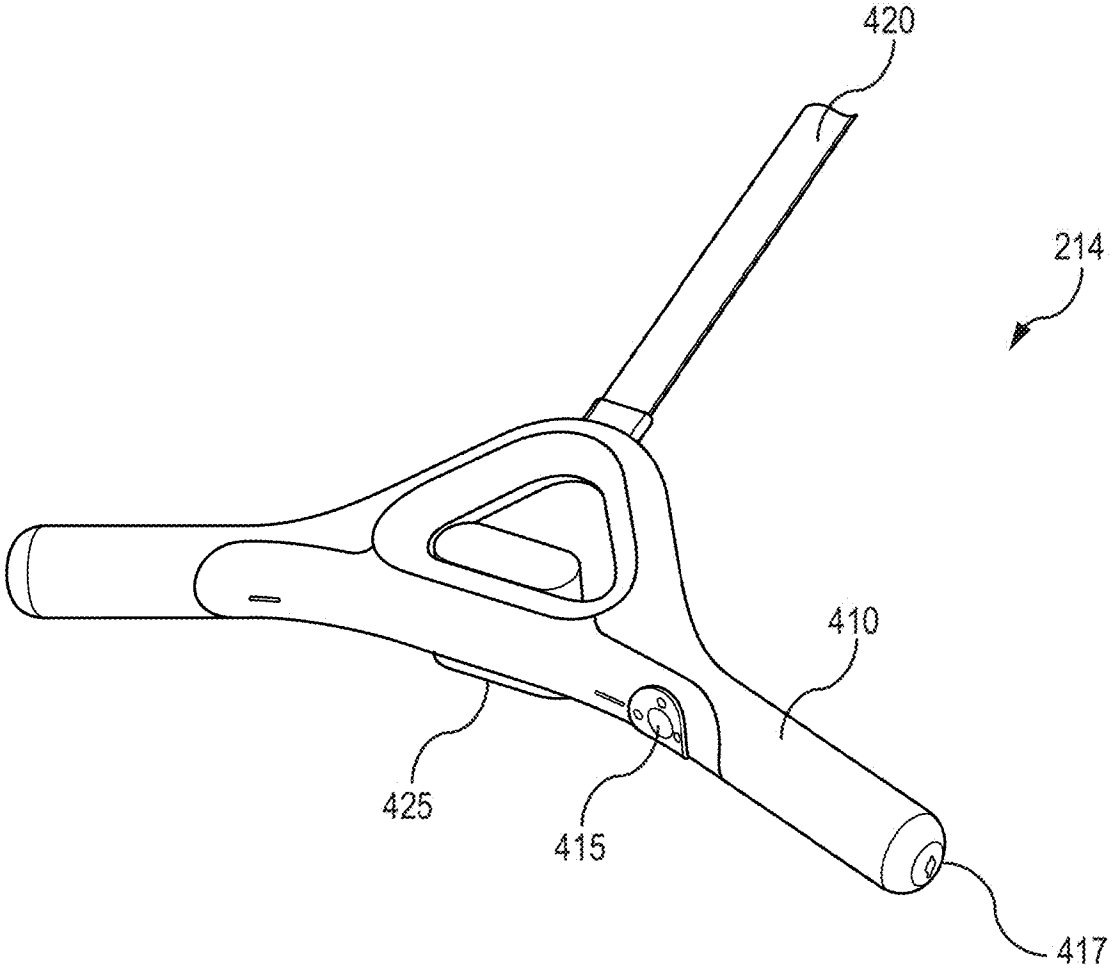
FIG. 4 is a diagram illustrating a handle for a rowing machine.

FIG. 4 is a diagram of the handle 214 of the rowing machine 200. The handle 214 may be made or formed of a molded plastic (e.g., 30% GF Nylon, PC/ABS, and PC, and/or 30% GF Nylon and TPE). As depicted, the handle 214 can include a housing 410 having a triangular shape, with a cord or cable 420 attached to one corner of handle 214. The handle 214 can include one or more may have controls 415, such as buttons, on a curved surface, as well as a docking system 425 with a charging component. For example, the docking system 425 can include a 4× pogo pin for charging and handle identification and/or a hall effect sensor or other sensor that detects when the handle 214 is docked. The handle 214 can also include a charging port 417 located on an end of the handle 214 (or, additional controls or buttons).

Figure 5:
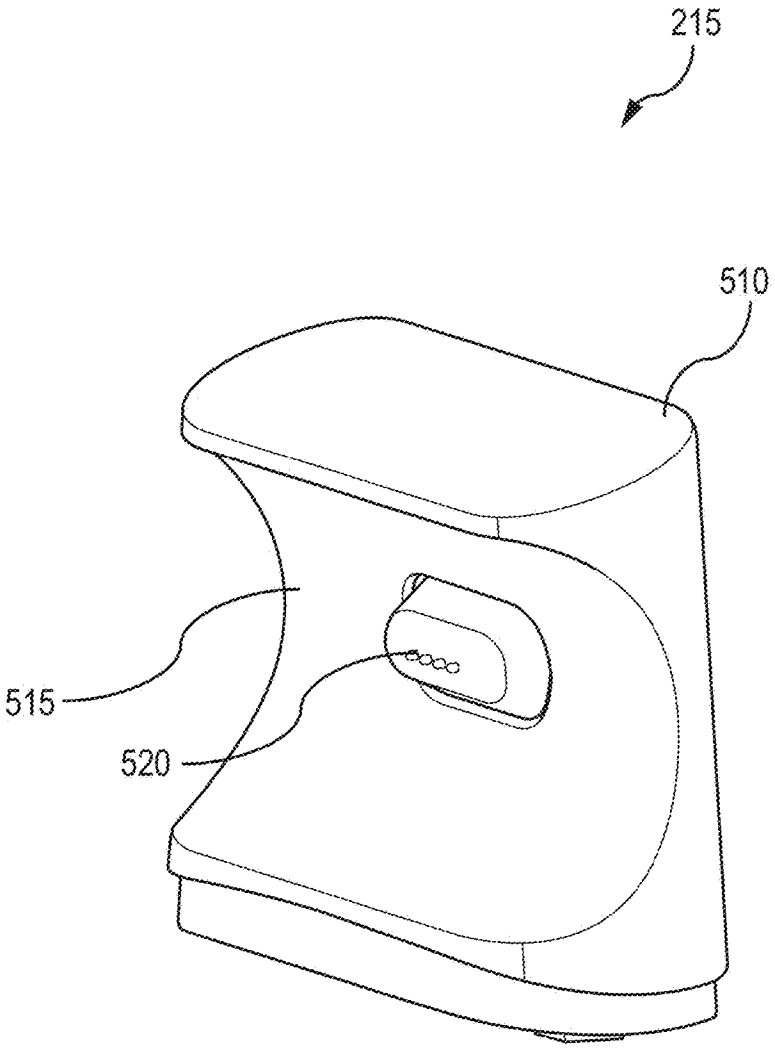
FIG. 5 is a diagram illustrating a handle dock for a rowing machine.

The handle 214 can be shaped to be docked or otherwise received by the handle dock 215. FIG. 5 is a diagram of the handle dock 215 of the rowing machine 200. The handle dock 215, or docking station, can include a housing 510 that having an interior shape 515 or docking area that matches the shape of the handle 214 when the handle 214 docks in the handle dock 214. Further, the handle dock 215 can include a hall effect sensor or other sensor that determines the handle 214 is docked and/or a pogo pad holder 520 that receives a pogo pad of the handle 214.

In some cases, the handle dock 215 charges the handle 214 when the handle 214 is docked. Further, the handle dock 215, via the hall effect sensor, can determine the handle 214 is docked, and reset the tracking of the handle 214 during a rowing activity. As described herein, the handle dock 215 can be located or disposed in front of the foot stretcher 211 and/or proximate to the drivetrain 202 or storage compartment 220.

Examples of a Storage Compartment for a Rowing Machine

FIGS. 6A-6D are diagrams illustrating the storage compartment 220 for the rowing machine 200. As described herein, the storage compartment 220 fits a wide variety of accessories, including a wide variety of water bottles and other objects, while being disposed between the foot stretcher 211 and/or proximate to the handle dock 215.

Figure 6A:
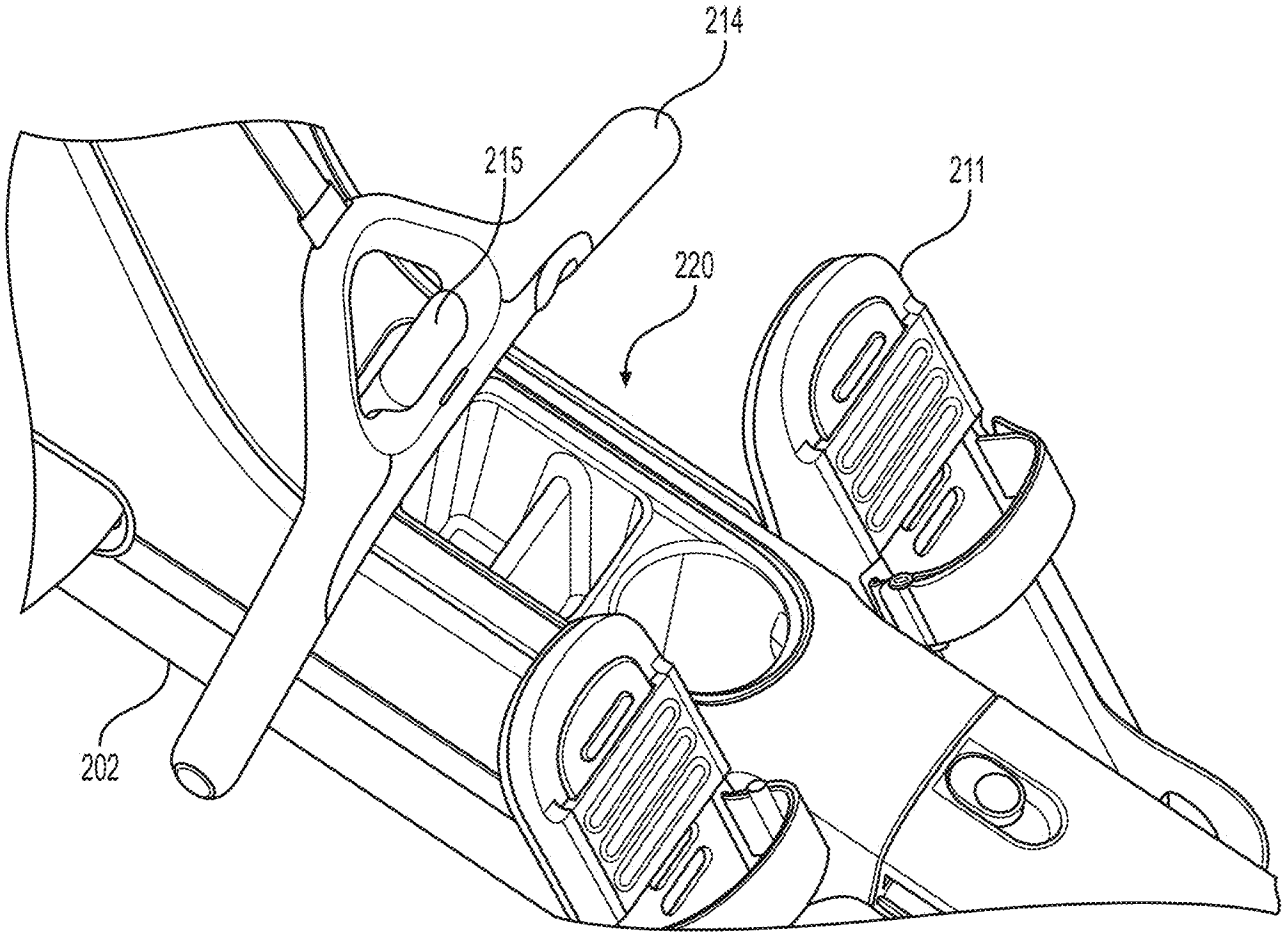
FIGS. 6A-6D are diagrams illustrating a storage compartment for a rowing machine.
Figure 6B:
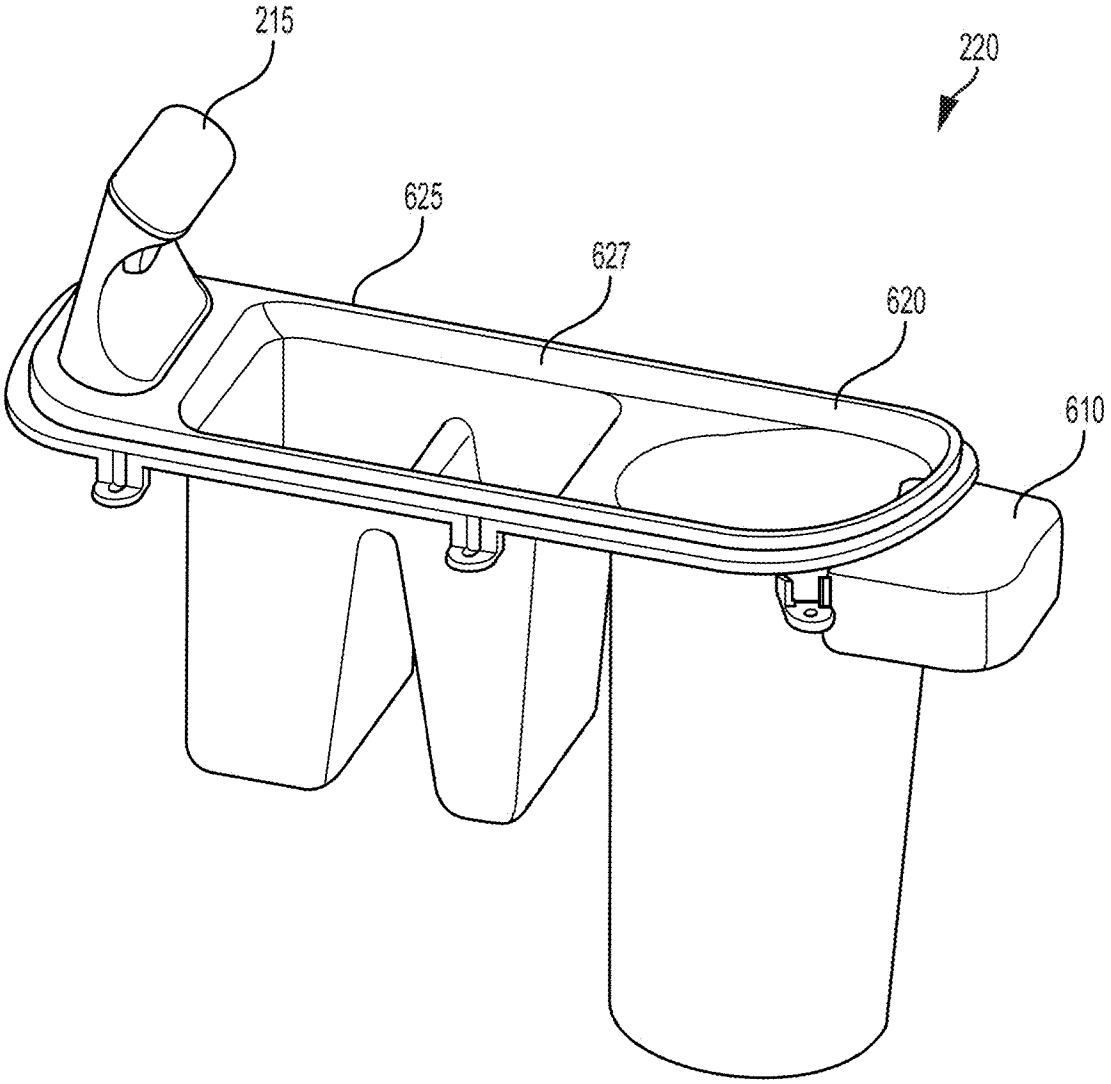

As shown in FIG. 6B, the storage compartment 120 can include different storage areas, including a bottle holder 620, an object holder 625, a phone holder 627, and so on. Further, the storage compartment 220 can include a handle 610 that enables a user to lift themselves out of the rowing machine 200 and can support or be attached to the handle dock 215.

Figure 6C:
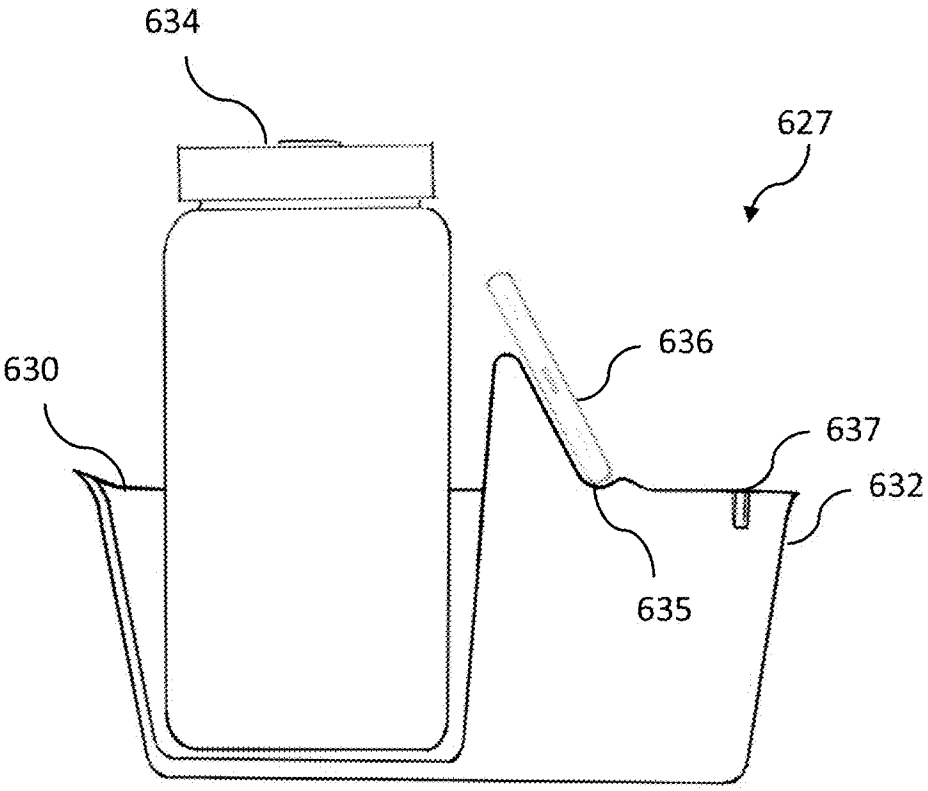

In some cases, the phone holder 627 can include a charger or charging mechanism, as well as a cable management device. For example, FIG. 6C depicts a storage compartment 635 including a water bottle area 630 that holds a water bottle 634, as well as a phone holder 632. The phone holder 632 can include a ledge 636 or surface that supports a mobile phone 636 in an orientation that enables a rower to view the display of the mobile phone 636, as well as a charging port (e.g., a USB port) that receives a charging cable of the phone 636. As described herein, the phone holder 632 can include inductive charging pads or elements.

Figure 6D:
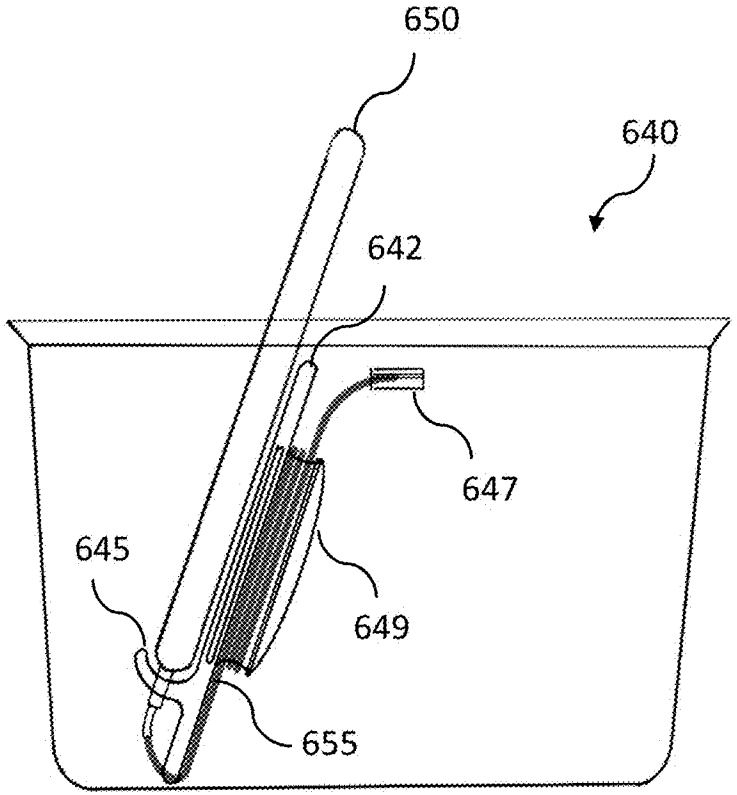

As another example, FIG. 6D depicts a phone holder 640 having an internal charging port 647 and inclined phone support 642 having a support ledge 645. The phone holder 640 also includes a cord management component 649, which is fixed to the phone support 642 and enables a rower to store their phone 650 and associated charging cord 655 in a managed, wrapped manner. Thus, the rower can charge their phone 650 when the phone 650 is contained by the storage component 640 during a workout using the rowing machine 200.

Examples of a Stowage System for a Rowing Machine

As described herein, the rowing machine 200, in some embodiments, is configured or designed to be stowed in an upright and secured position. For example, the hub 208 can include wheel stabilizers 210 and have a weight that facilitates supporting the rowing machine 200 in a vertical or upright position (e.g., with the rear end of the rail 224 pointing upwards). Further, the rowing machine 200 can include components to lock the seat 204 to the rail 224 and includes the rail handle 206 at a position or location on the rail 224 that is closer to the rear end of the rail 224, to facilitate the lifting and moving of the rowing machine 200 to the upright position.

Figure 7:
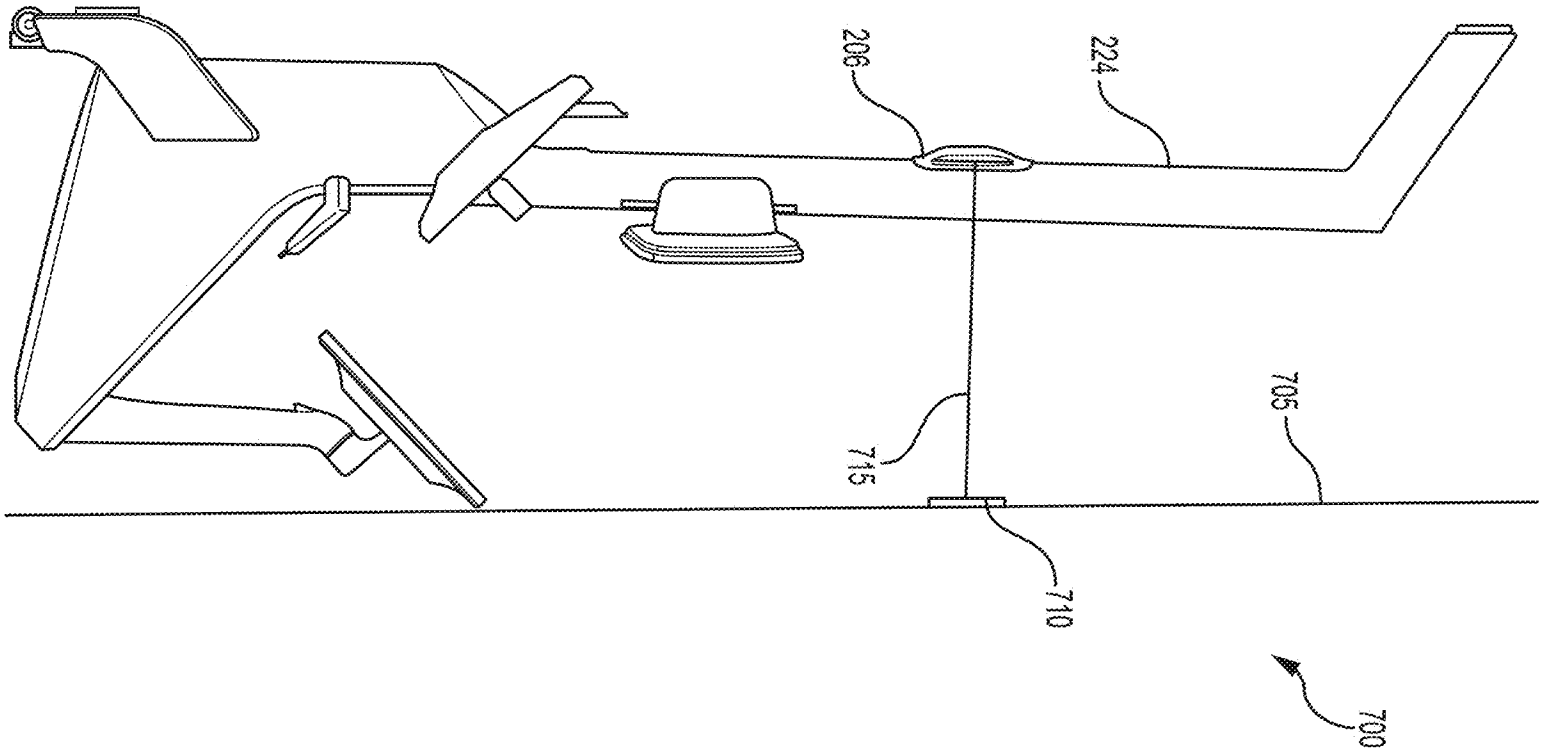
FIG. 7 is a diagram illustrating a rowing machine in an upright position.

FIG. 7 is a diagram 700 illustrating the rowing machine 200 secured to a vertical surface 705 (e.g., a wall). A wall mount 710 is fixed to the vertical surface 705 and includes a strap or cord 715 that wraps around the rowing machine 200, such as through an opening formed by the rail handle 206 and the rail 224, to secure or anchor the rowing machine 200 in the upright position. As depicted, the rail handle 206 is positioned at a similar height to the wall mount 710, such that the strap 715 can wrap through the rail handle 206 in a horizontal direction and tightly fix or secure the rail 224 in the vertical orientation.

Figure 8B:
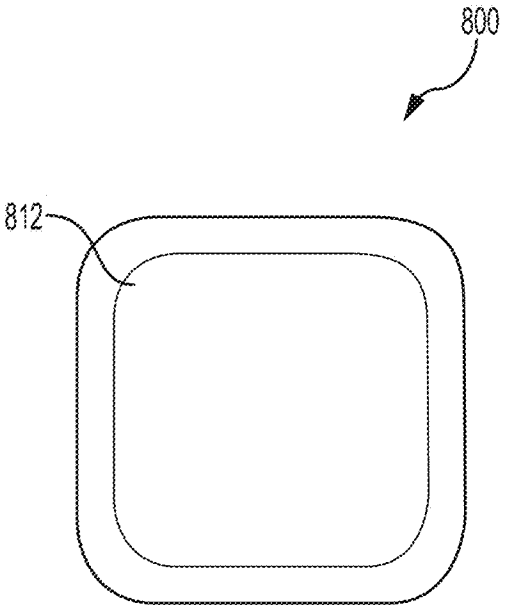
FIGS. 8A-8B are diagrams illustrating a wall mount for a rowing machine.
Figure 8A:
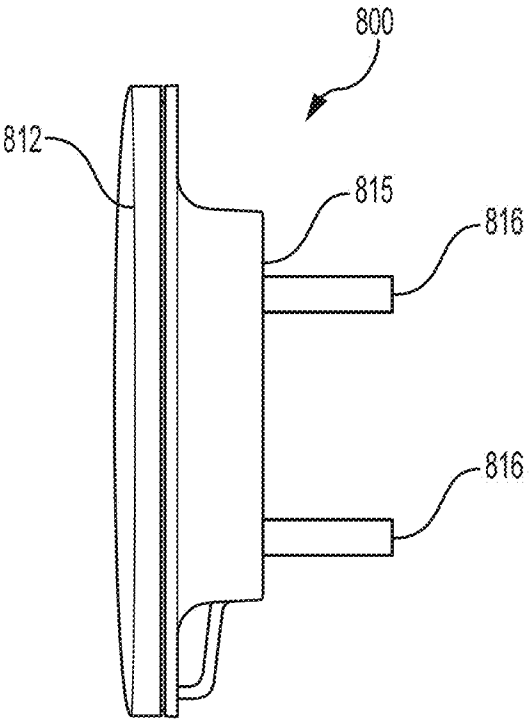

The wall mount 710 can be configured in a variety of ways. For example, FIGS. 8A-8B depict a wall mount 800 having a generally flat front surface 812 or cover, a panel 815 that can support or contain the strap 715 when not in use (e.g., the strap 715 wraps around the panel and is at least partially covered by the cover 812), and wall anchors 816 that secure the wall mount 800 to the wall.

Figure 9B:
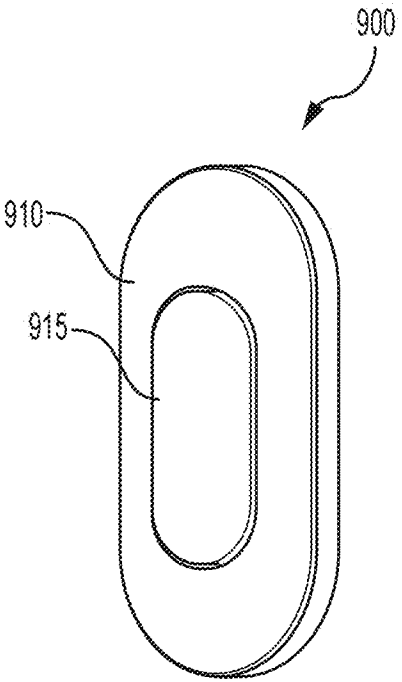
FIGS. 9A-9B are diagrams illustrating another wall mount for a rowing machine.
Figure 9A:
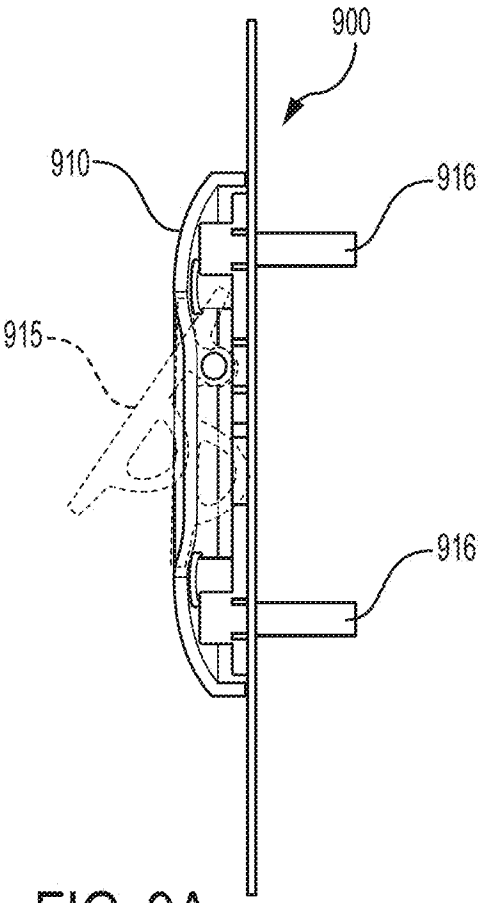
Figure 10:
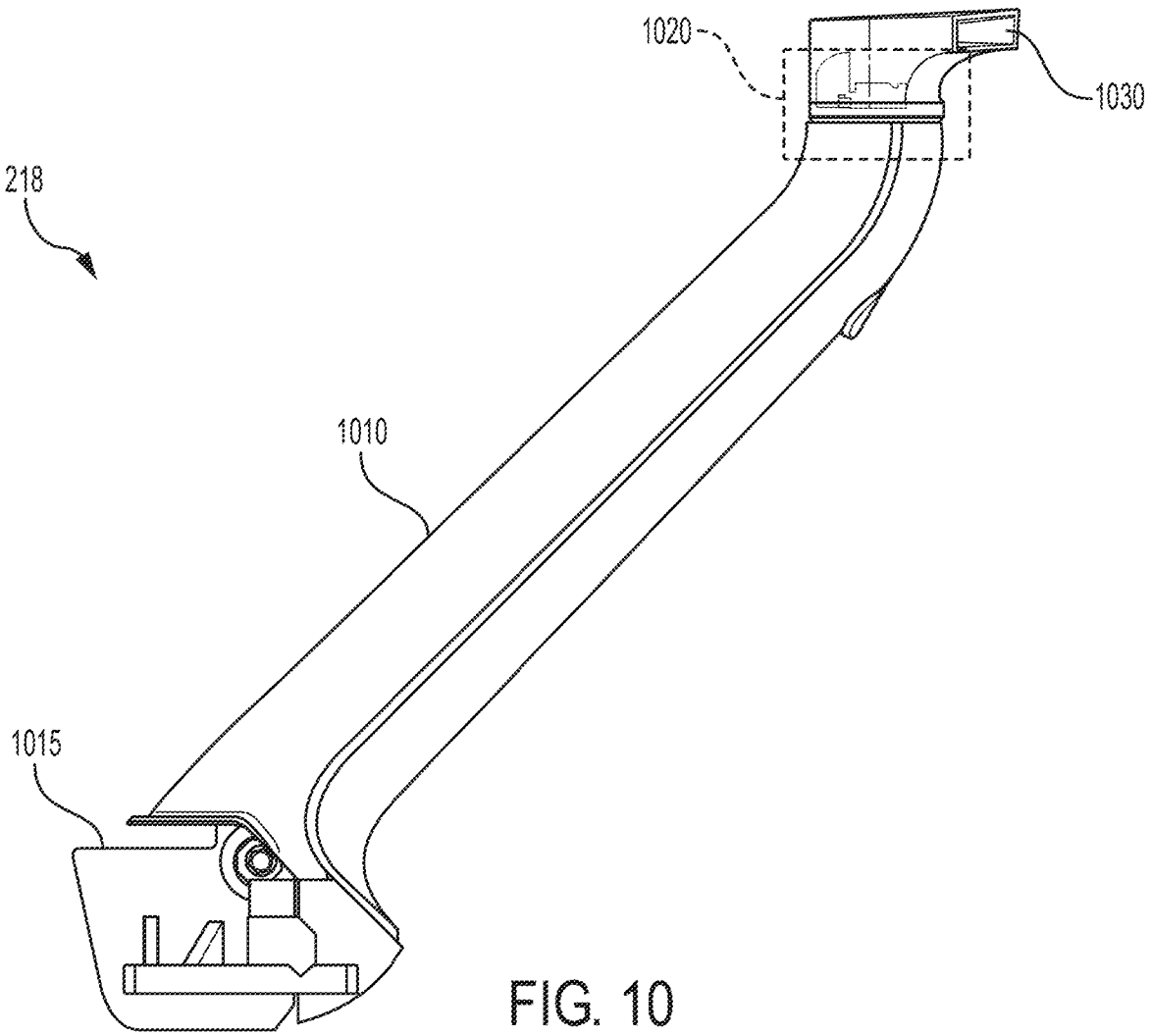
FIG. 10 is a diagram illustrating a display mount for a rowing machine.

As another example, FIGS. 9A-9B depict a wall mount 900 that includes a hook 915 disposed within a cover 910 and configured to be extended outwards to receive or secure a strap to the wall mount 900. The wall mount 900 is fixed to a vertical surface via wall anchors 916. The hook 915 may be formed of cast aluminum and located at a center of the cover 910. In some cases, the hook 915 can be pushed to pivot open and/or closed. The strap can be clipped or otherwise secured to the hook 915, such as via a carabiner or other attachment device.

Examples of a Display Mount for a Rowing Machine

As described herein, in some embodiments, the rowing machine 200 includes the display mount 218, which facilitates the swivel or rotation of the display 216 and/or the folding of the display 216. The display mount 218 includes a housing 1010 that contains a folding mechanism, a knuckle 1015 that secures the display mount 218 to the hub 208 of the rowing machine 200, a swivel hinge 1020, and a neck 1030 that facilitates securement of the display 216 to the display mount 216.

Figure 11B:
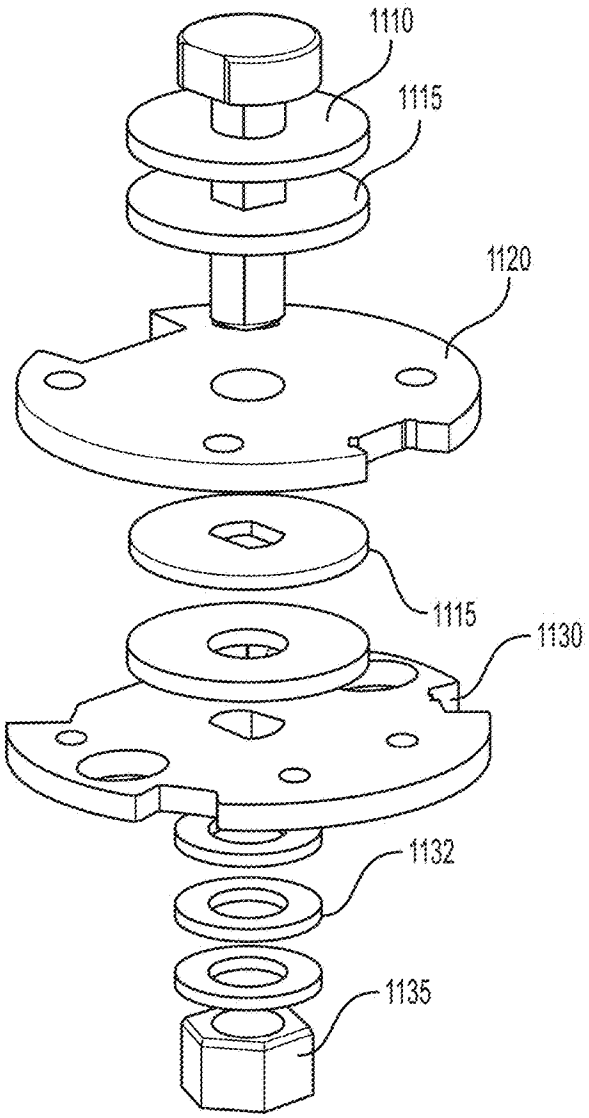
FIGS. 11A-11B are diagrams illustrating a swivel mount for a display mount.
Figure 11A:
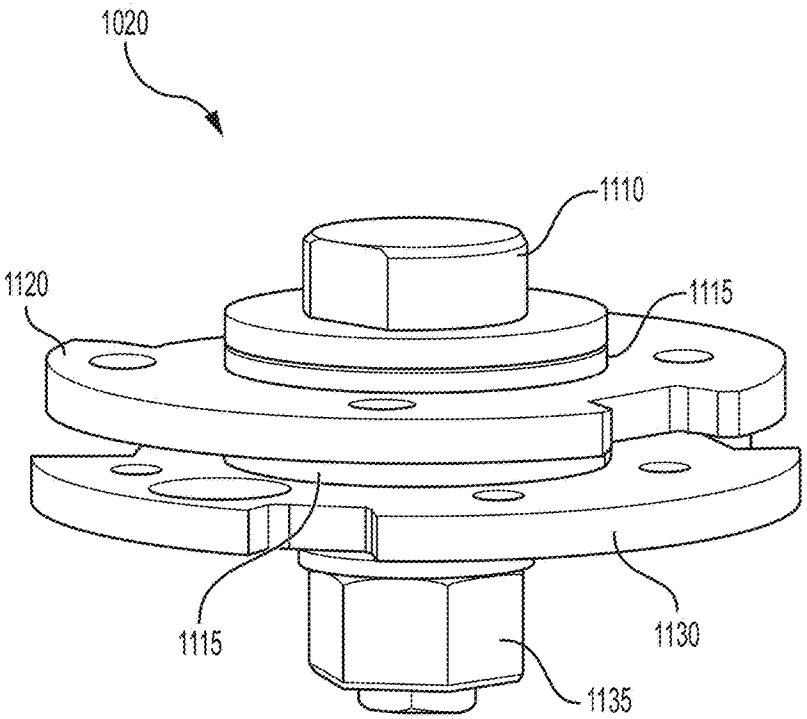

FIG. 11A-11B depict various components of the swivel hinge 1020. The swivel hinge 1020 can be made of sheet metal or similar materials. The swivel hinge 1020 can swivel or rotate the display 216, such as 90 degrees in either a clockwise or counterclockwise direction. For example, a user can swivel the display 216 to view content (e.g., a streaming class) when not on the rowing machine 200. The swivel hinge 1020 can include a clamping bolt 1110, friction washers 1115, a rotating plate 1120, a mounting plate 1130, Belleville washers 1132, and a nylon bolt 1135.

Figure 12:
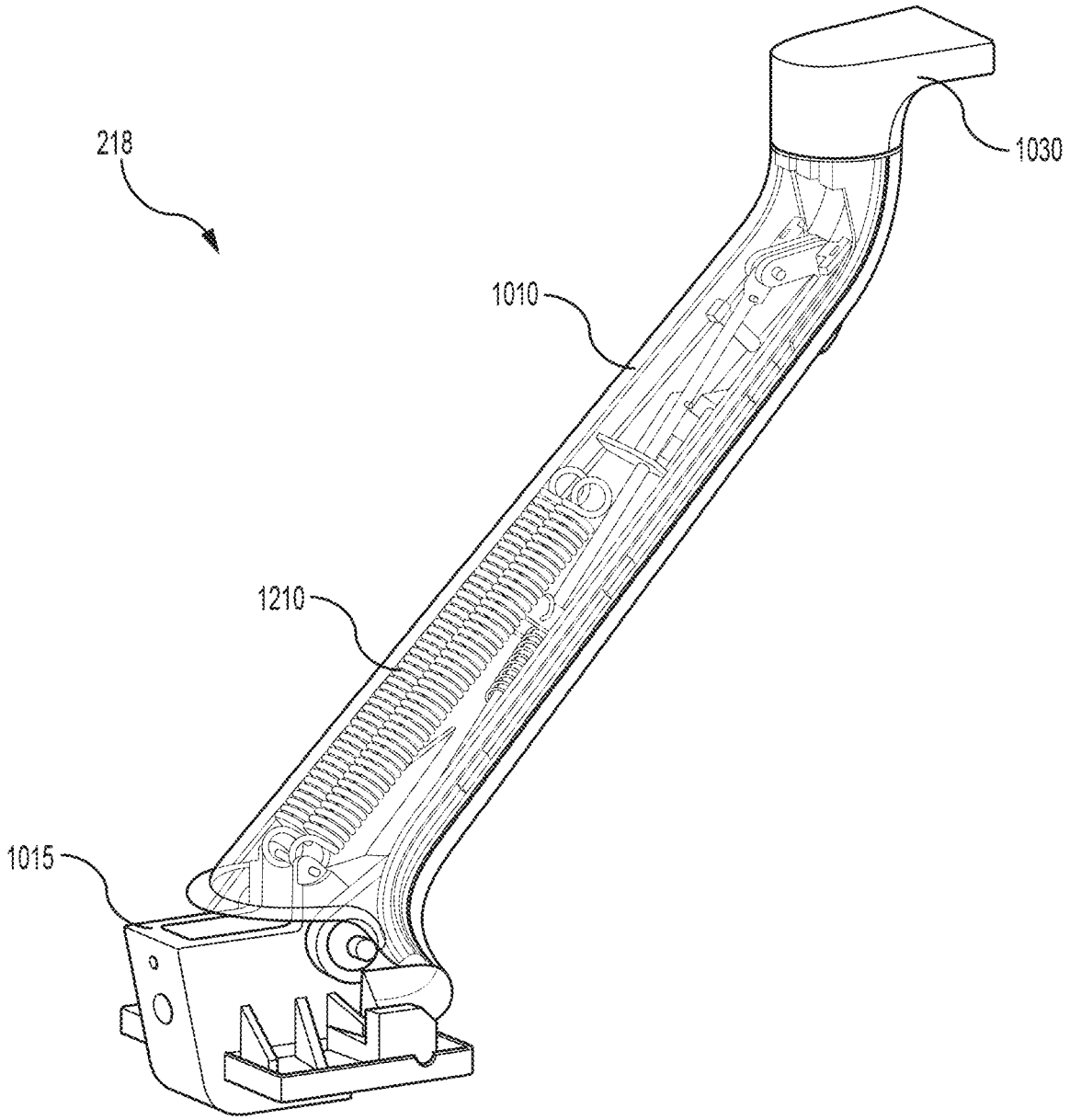
FIGS. 12-13 are diagrams illustrating a folding mechanism for a display mount.

FIG. 12 depicts a folding mechanism 1210 of the display mount 218. The folding mechanism 1210 can include an aluminum die-casting, plastic injection modeling, springs, and pins. In some cases, the folding mechanism 1210 includes a plunger locking and release functionality. The folding mechanism 1210 enables the display 216 to be folded or moved towards the drivetrain 202 of the rowing machine 200, for easier transport and storage, among other configurations or benefits.

Figure 13:
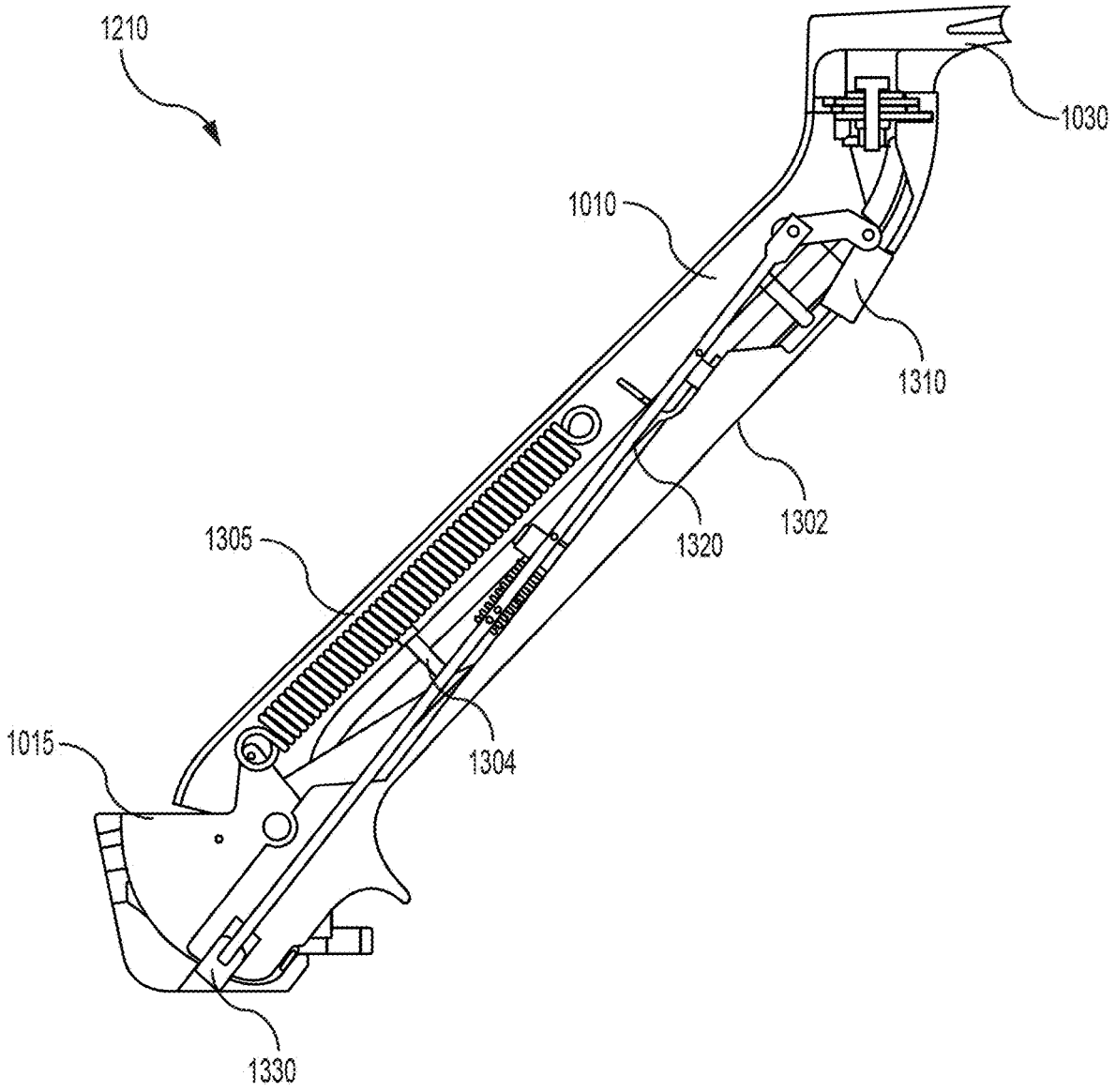

FIG. 13 illustrates different components of the folding mechanism 1210. For example, the folding mechanism 1210 (or the display mount 218) includes a monitor arm front 1302, a folding pin axis 1304, counterbalance springs 1305, a wireform rod 1320, an actuator 1310, and a plunger 1330.

Thus, in various embodiments, the display mount 218 can include components that facilitate the movement of the display 216 in three-dimensional space, including rotation around a horizontal axis (e.g., when folding) and/or rotation around a vertical axis (when swiveling).

Examples of a Foot Stretcher for a Rowing Machine

Figure 14A:
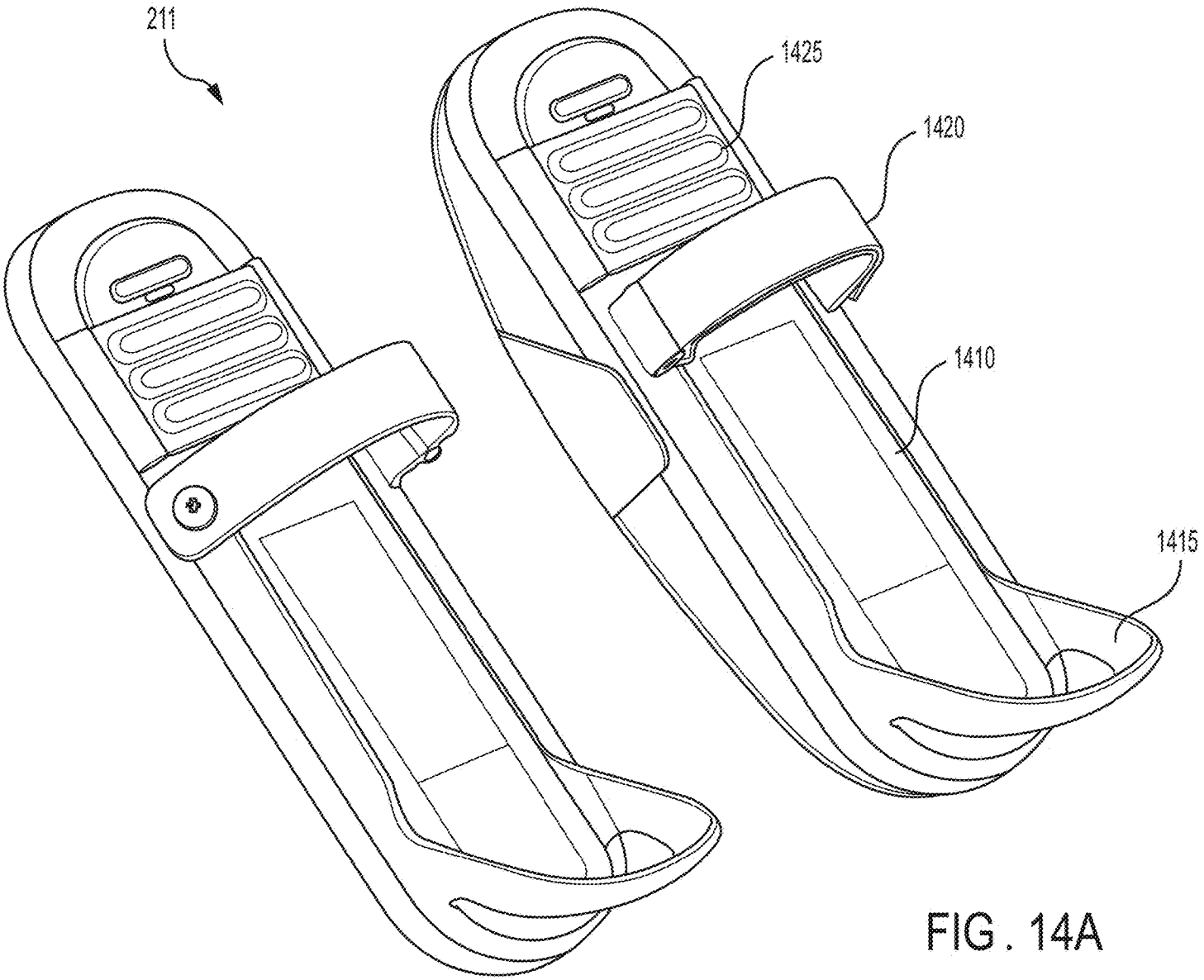
FIGS. 14A-14B are diagrams illustrating a foot stretcher for a rowing machine.
Figure 14B:
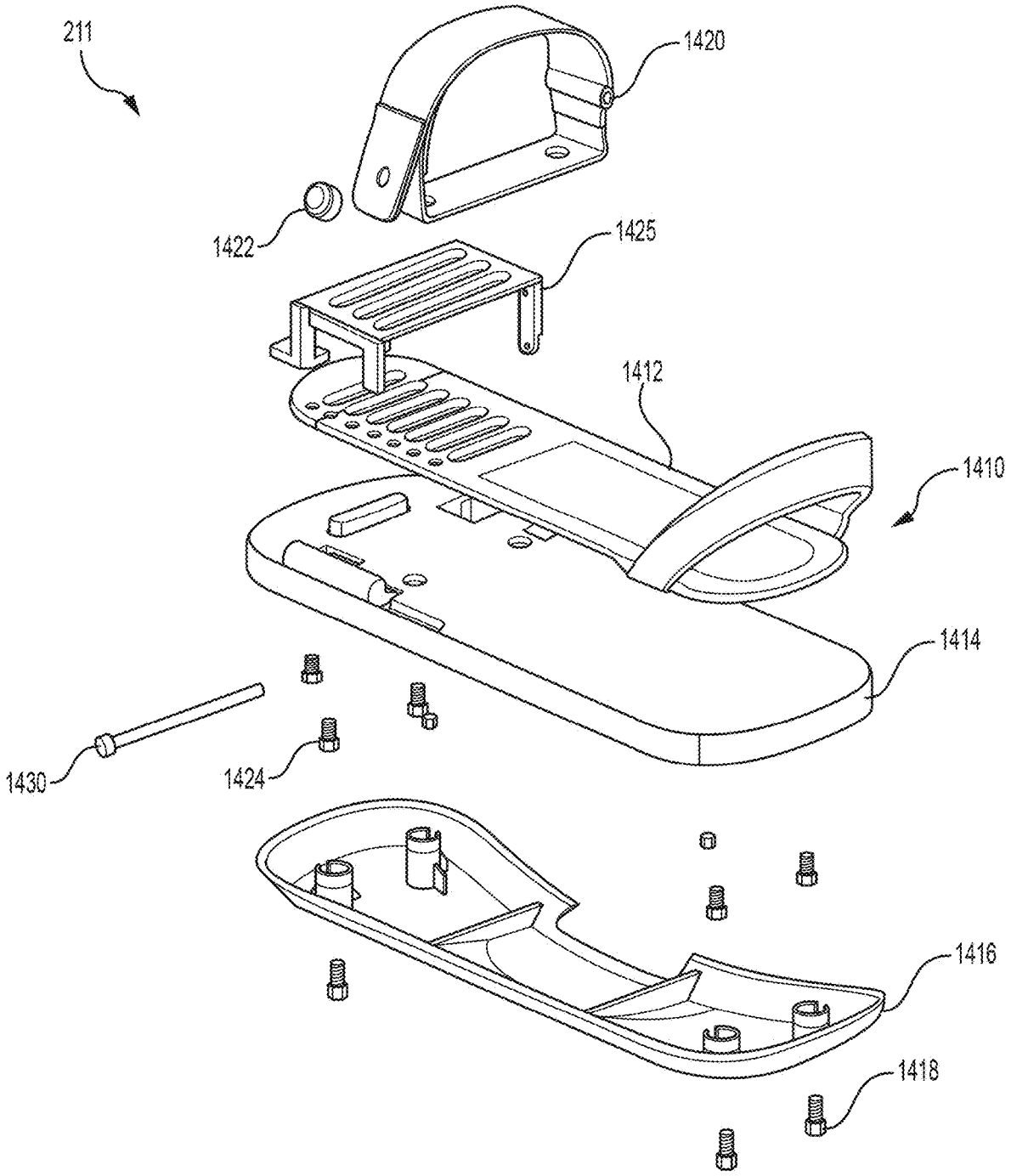

As described herein, the foot stretcher 211 can include a spring-loaded mechanism that facilitates a one-handed securement or release of a user's foot to or from the rowing machine 200, among other benefits. FIGS. 14A-14B illustrate components of the foot stretcher 211.

The foot stretcher 211 can be made of various materials, including injection molded plastics and nylon webbing. As described herein, the foot stretcher 211 includes a pair of stretchers. The foot stretcher 211 includes a housing 1410, a heel strap or support 1415, a foot binding 1420, and a top plate 1425.

The housing 1410 includes a top housing 1414 and a bottom housing 1416. The top housing 1414 and the bottom housing 1416 can be made of plastic. A top component 1412 is attached or disposed to a top of the housing 1410. A rivet 1422, such as a cosmetic rivet, can secure the foot strap or binding 1420. Further, threaded inserts 2518, springs 1424, and a pin 1430 may attach the bottom housing 1416 to the top housing 1414.

Figure 15A:
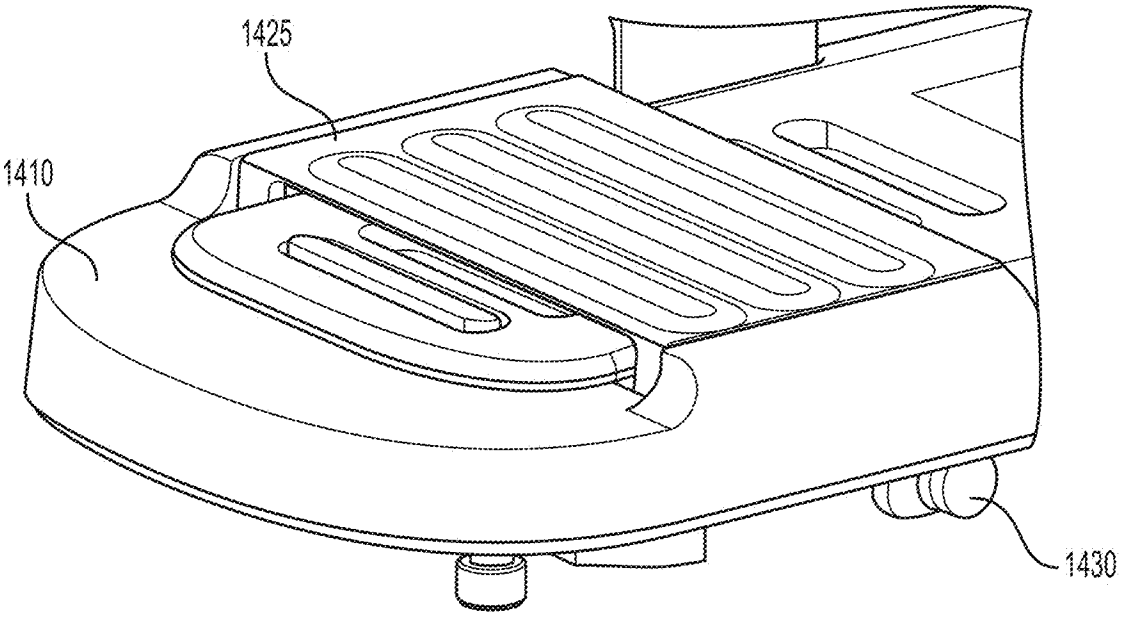
FIGS. 15A-15B are diagrams illustrating the positions of a foot stretcher for a rowing machine.
Figure 15B:
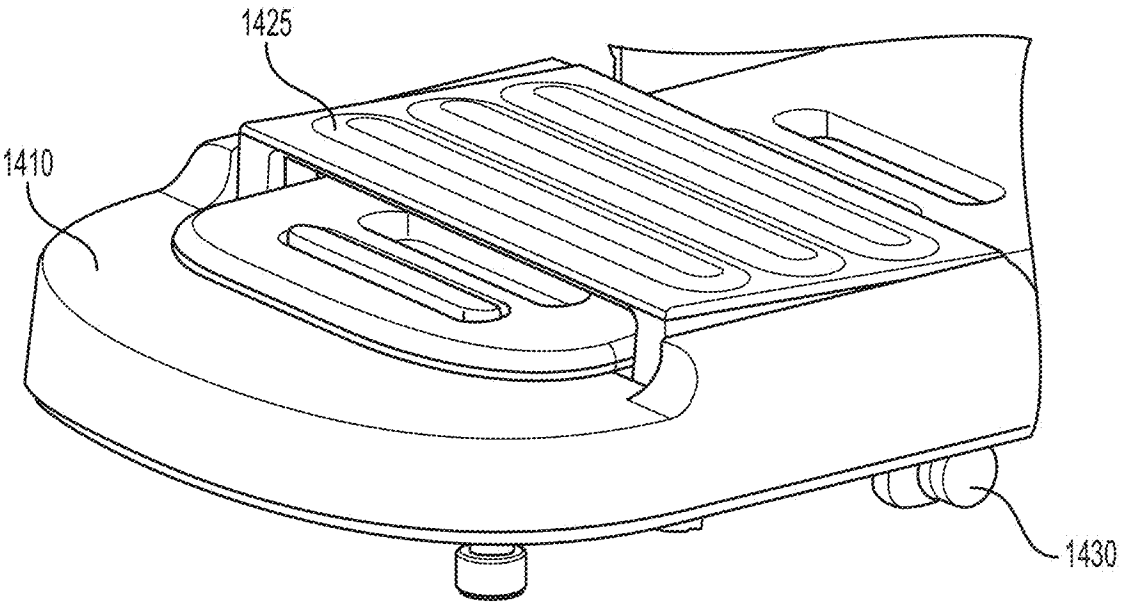

The top plate 1425 can be a spring-loaded top plate for easier foot size adjustment and/or opening of the foot stretcher 211. As depicted in FIGS. 15A-15B, the top plate 1425 can have a closed position (FIG. 15A) or an open position (FIG. 15B). For example, when the top plate 1425 is in an open position, the user can easily (e.g., with one hand) insert or remove a foot from the housing 1410. Then, when the foot is secure in the stretcher, the user can perform a rowing activity using the rowing machine 200.

Examples of Changing a Strap of a Rowing Machine

As described herein, in some embodiments, the hub 208 can have a structure that facilitates the removal and/or addition of a strap (e.g., a webbing swap), such as the 420 that couples the handle 214 to the drivetrain 202. FIGS. 15A-15F depict a process of performing a webbing swap for the rowing machine 200.

Figure 16B:
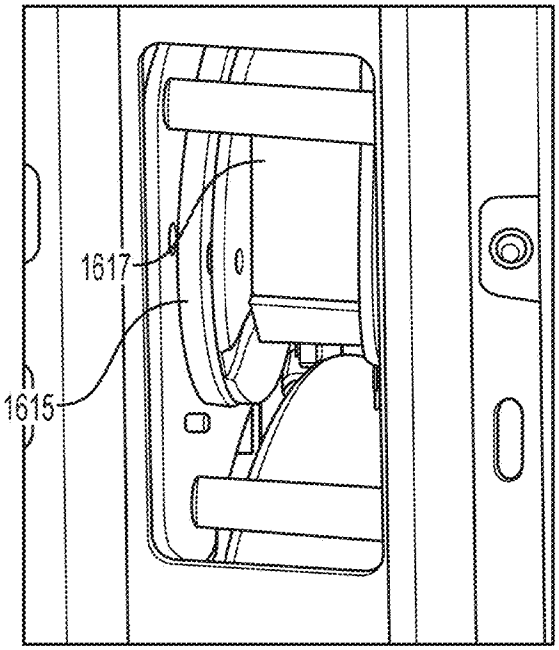
FIGS. 16A-16F are diagrams illustrating steps of a webbing swap procedure for a rowing machine.
Figure 16A:
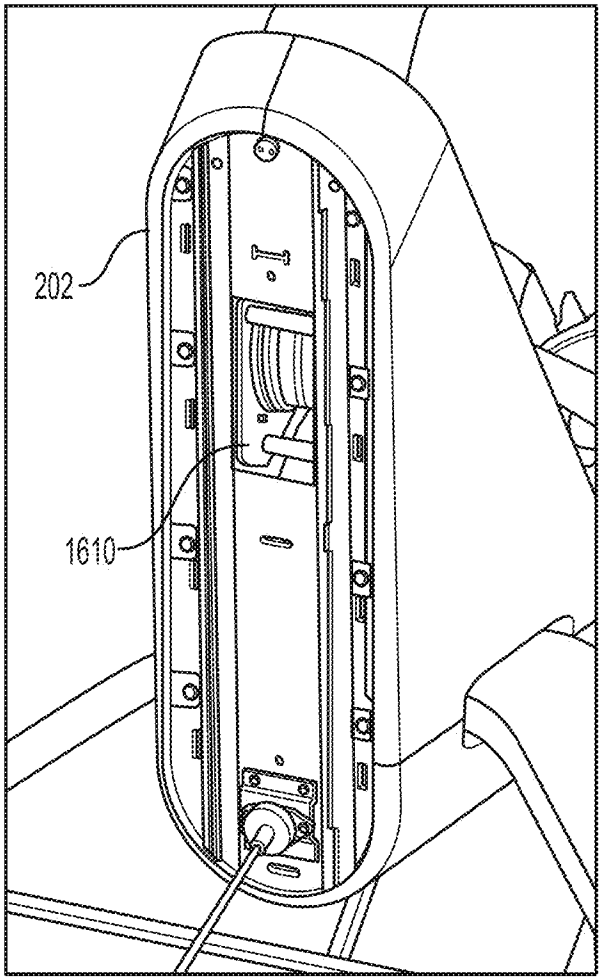

In FIG. 16A, a back panel of the hub 208 is removed, exposing an opening 1610 or access area. In FIG. 16B, the handle 214 is pulled out, and a webbing 1617 is unspooled from a pulley 1615 around which the webbing is wrapped.

Figure 16D:
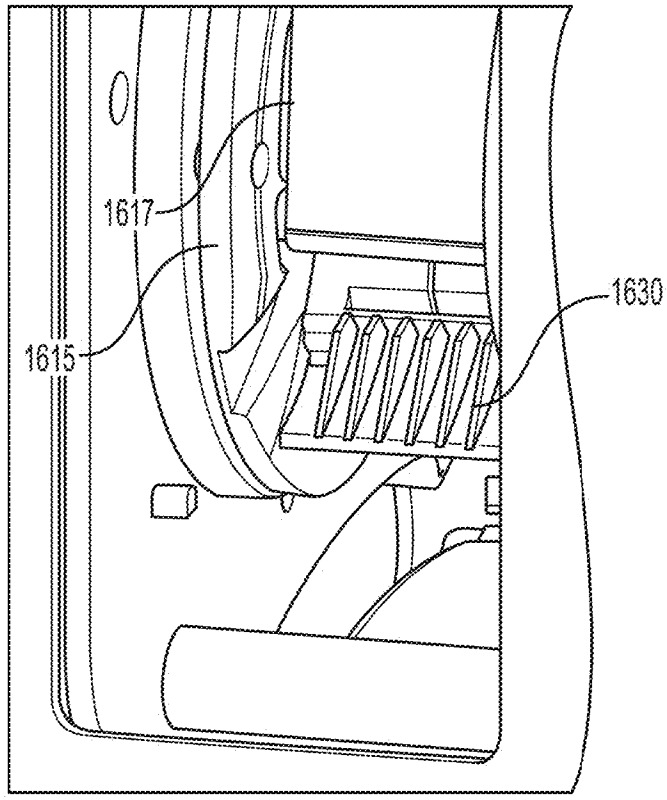
Figure 16C:
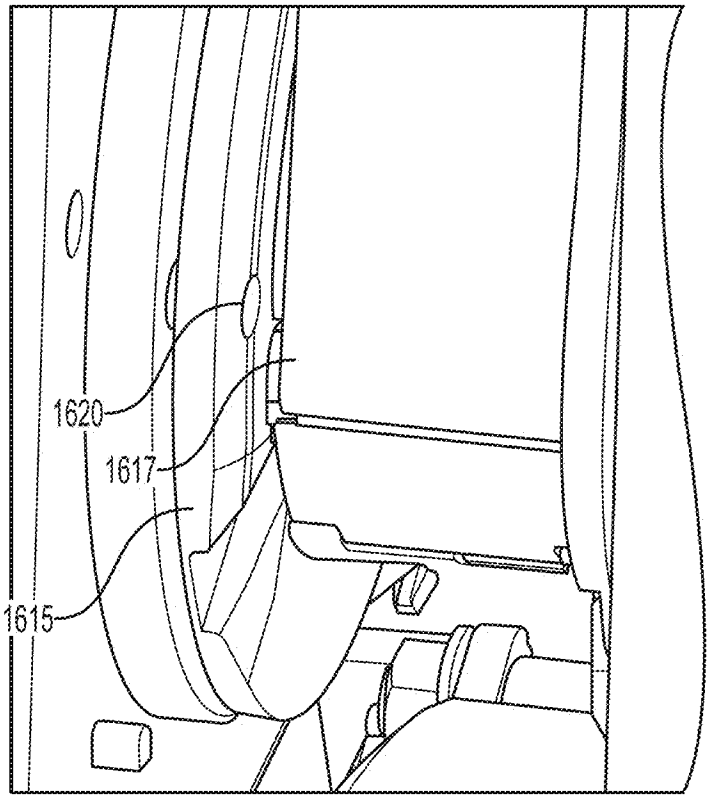

In FIG. 16C, the pre-tension of an internal recoil spring is maintained (holding the pulley in place), by inserting a wrench or other tool into one of more holes 1620 of the pulley 1615. In FIG. 16D, a door 1630 on the pulley 1615 is opened, and a webbing pin is pulled out of a track of the pulley 1615. The remaining webbing 1617 can be removed from the hub 208 (via the other side of the hub 208).

Figure 16F:
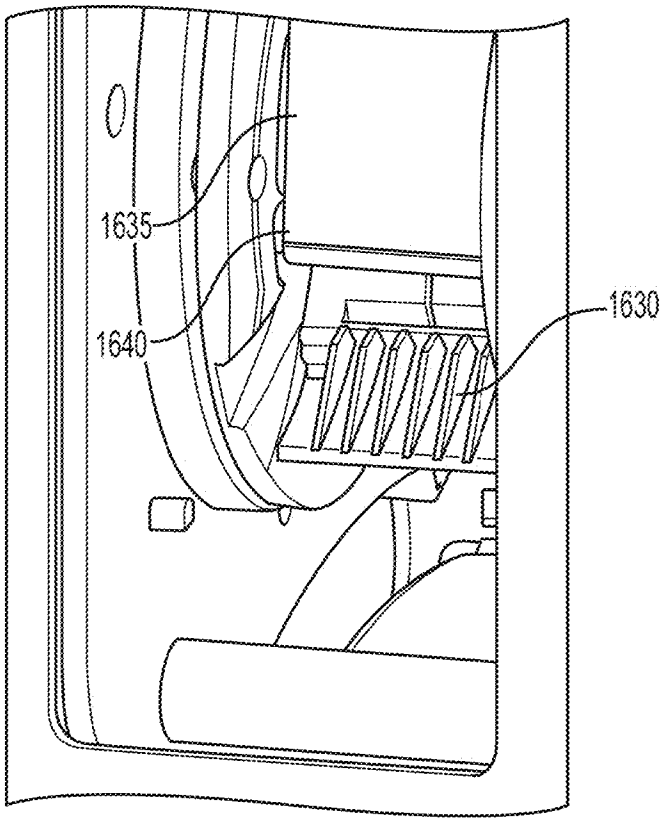
Figure 16E:
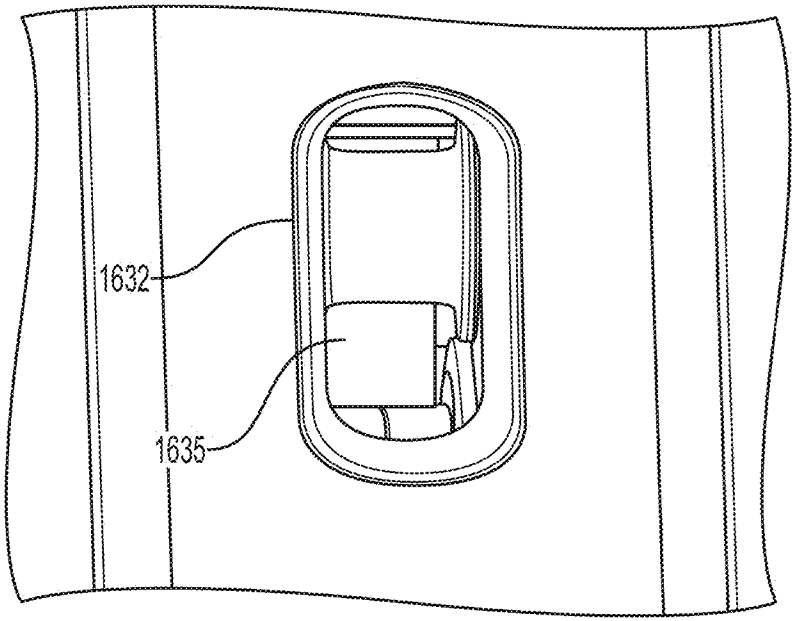

In FIG. 16E, a new webbing 1635 is fed through a front opening 1632 of the hub 208, and, in FIG. 16F, the new webbing 1635 is secured. For example, a webbing pin 1640 in reinserted and the webbing door 1630 is closed. The tool is removed from the holes 1620, and the new webbing 1635 is fed to the pulley 1615 as it automatically rotates based on the recoil spring tension.

Examples of the Disclosed Technology

In some embodiments, a rowing machine includes a drivetrain, a handle that is coupled to the drivetrain, a seat that moves along a rail and a sensor system, including: a seat sensor that is configured to detect a position of the seat along the rail and a handle sensor that is configured to detect a position of the handle.

In some cases, the sensor system includes a user form system that determines a form of a user performing a rowing activity via the rowing machine based on the detected position of the seat along the rail in relation to the detected position of the handle.

In some cases, the seat sensor is a time-of-flight (ToF) sensor disposed on the rail.

In some cases, the seat sensor is a ToF sensor that captures distance information for the seat as the seat moves along the rail.

In some cases, the handle sensor is an encoder that captures rotation information for a flywheel of the drivetrain.

In some cases, the rowing machine includes a handle dock that includes a hall effect sensor.

In some cases, the rowing machine includes a display device that is configured to present interactive content to a user performing a rowing activity via the rowing machine.

In some embodiments, a rowing machine includes a housing, a drivetrain at least partially contained by the housing, a handle that is coupled to the drivetrain, a seat that moves along a rail that extends out of the housing, a display device that is configured to present interactive content to a user performing a rowing activity via the rowing machine, and a mount that is fixed to the housing and is configured to support the display device, where the mount includes a swivel hinge and a folding mechanism.

In some cases, the swivel hinge includes a rotating plate that facilitates rotation of the display device, a mounting plate that facilitates securement of the mount to the housing of the rowing machine, and a friction plate disposed between the rotating plate and the mounting plate.

In some cases, the folding mechanism includes counterbalance springs, a wireform rod, an actuator, and a plunger.

In some cases, the mount facilitates the display device to perform a swivel movement and a folding movement.

In some embodiments, a rowing machine includes a housing, a drivetrain at least partially contained by the housing, a handle that is coupled to the drivetrain, a seat that moves along a rail that extends out of the housing, and a pair of foot stretchers, wherein each foot stretcher includes a spring-loaded top plate and a foot strap.

In some cases, each foot stretcher is configured to be in an open position upon movement of the spring-loaded top plate towards a top area of the foot stretcher and configured to be in a closed position upon movement of the spring-loaded top plate towards a bottom area of the foot stretcher.

In some embodiments, a rowing machine includes a housing, a drivetrain at least partially contained by the housing, a handle that is coupled to the drivetrain, a seat that moves along a rail that extends out of the housing, and a rail handle disposed on a bottom portion of a rear area of the rail.

In some cases, the rail handle includes an opening configured to receive an attachment device when the rowing machine is positioned proximate to a wall-mounted securement device.

In some cases, the rowing machine includes a display device that is configured to present interactive content to a user performing a rowing activity via the rowing machine and a foldable mount that is fixed to the housing and is configured to support the display device, where the foldable mount includes a folding mechanism that facilitates positioning the display device proximate to the rail when the rowing machine is in a stowed position.

In some embodiments, an exercise machine that facilitates performance of a rowing activity includes a drivetrain contained within a housing, a rail that extends from the housing, a seat that moves along the rail, a handle that is coupled to the drivetrain, and a sensor-based positioning system that tracks movement of the seat relative to movement of the handle during the performance of the rowing activity by a user of the exercise machine.

In some cases, the sensor-based positioning system includes a time-of-flight (ToF) sensor that captures position information for the seat during the the performance of the rowing activity and an encoder that captures position information for the handle during the performance of the rowing activity.

In some cases, the sensor-based positioning system tracks a position of the seat relative to a position of the handle during the performance of the rowing activity.

In some cases, the sensor-based positioning system tracks a velocity of the seat relative to a velocity of the handle during the performance of the rowing activity.

In some cases, the sensor-based positioning system tracks a position and velocity of the seat relative to a position and velocity of the handle during the performance of the rowing activity.

In some cases, the sensor-based positioning system tracks an acceleration of the seat relative to an acceleration of the handle during the performance of the rowing activity.

In some cases, the sensor-based positioning system tracks a position and acceleration of the seat relative to a position and acceleration of the handle during the performance of the rowing activity.

In some cases, the exercise machine includes a display device that presents a user interface, where the user interface is configured to render an avatar of the user performing the rowing activity based on the tracked movement of the seat relative to the movement of the handle.

In some embodiments, a rowing machine includes a housing, a drivetrain at least partially contained by the housing, a handle that is coupled to the drivetrain, a seat that moves along a rail that extends out of the housing, a pair of foot stretchers, and a storage component disposed at least partially between the pair of foot stretchers.

In some cases, the storage component includes a bottle storage area and a charging port.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the electric bike and bike frame may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

From the foregoing, it will be appreciated that specific embodiments have been described herein for purposes of illustration, but that various modifications may be made without deviating from the spirit and scope of the embodiments. Accordingly, the embodiments are not limited except as by the appended claims.

What is claimed is:

1. A rowing machine, comprising:
- a drivetrain at least partially contained by a housing;
- a mount that is fixed to the housing and is configured to support a display device, the mount including:
  - a swivel hinge; and
  - a folding mechanism comprising counterbalance springs located within the mount and aligned along a longitudinal axis of the mount;
- a handle that is coupled to the drivetrain;
- a seat that moves along a rail; and
- a sensor system, including:
  - a seat sensor that is configured to detect a position of the seat along the rail; and
  - a handle sensor that is configured to detect a position of the handle.

2. The rowing machine of claim 1, wherein the sensor system further comprises:
- a user form system that determines a form of a user performing a rowing activity via the rowing machine based on the detected position of the seat along the rail in relation to the detected position of the handle.

3. The rowing machine of claim 1, wherein the seat sensor is a time-of-flight (ToF) sensor that captures distance information for the seat as the seat moves along the rail.

4. The rowing machine of claim 1, wherein the handle sensor is an encoder that captures rotation information for a flywheel of the drivetrain.

5. The rowing machine of claim 1, further comprising:
- a handle dock that includes a hall effect sensor.

6. The rowing machine of claim 1, wherein the display device is configured to present interactive content to a user performing a rowing activity via the rowing machine.

7. The rowing machine of claim 6, wherein the swivel hinge includes:
- a rotating plate that facilitates rotation of the display device;
- a mounting plate that facilitates securement of the mount to the housing of the rowing machine; and
- a friction plate disposed between the rotating plate and the mounting plate.

8. The rowing machine of claim 6, wherein the folding mechanism further includes:
- a wireform rod;
- an actuator; and
- a plunger.

9. The rowing machine of claim 6, wherein the mount facilitates the display device to perform a swivel movement and a folding movement.

10. The rowing machine of claim 1, further comprising:
- a pair of foot stretchers, wherein each foot stretcher includes:
  - a spring-loaded top plate; and
  - a foot strap.

11. The rowing machine of claim 10, wherein each foot stretcher is:
- configured to be in an open position upon movement of the spring-loaded top plate towards a top area of the foot stretcher; and
- configured to be in a closed position upon movement of the spring-loaded top plate towards a bottom area of the foot stretcher.

12. The rowing machine of claim 1, further comprising:
- a rail handle disposed on a bottom portion of a rear area of the rail.

13. The rowing machine of claim 12, wherein the rail handle includes an opening configured to receive an attachment device when the rowing machine is positioned proximate to a wall-mounted securement device.

14. An exercise machine that facilitates performance of a rowing activity, the exercise machine comprising:
- a drivetrain contained within a housing;
- a mount that is fixed to the housing and is configured to support a display device, the mount including:
  - a swivel hinge; and
  - a folding mechanism comprising counterbalance springs located within the mount and aligned along a longitudinal axis of the mount;
- a rail that extends from the housing;
- a seat that moves along the rail; and
- a handle that is coupled to the drivetrain.

15. The exercise machine of claim 14, wherein the sensor-based positioning system includes:
- a sensor-based positioning system that tracks movement of the seat relative to movement of the handle during the performance of the rowing activity by a user of the exercise machine;
- a time-of-flight (ToF) sensor that captures position information for the seat during the performance of the rowing activity; and
- an encoder that captures position information for the handle during the performance of the rowing activity.

16. The exercise machine of claim 15, wherein the sensor-based positioning system tracks a position of the seat relative to a position of the handle during the performance of the rowing activity.

17. The exercise machine of claim 15, wherein the sensor-based positioning system tracks a velocity of the seat relative to a velocity of the handle during the performance of the rowing activity.

18. The exercise machine of claim 15, wherein the sensor-based positioning system tracks an acceleration of the seat relative to an acceleration of the handle during the performance of the rowing activity.

19. The exercise machine of claim 15, further comprising:

a display device that presents a user interface, wherein the user interface is configured to render an avatar of the user performing the rowing activity based on the tracked movement of the seat relative to the movement of the handle.

20. A rowing machine, comprising:

a housing;

a drivetrain at least partially contained by the housing;

a mount that is fixed to the housing and is configured to support a display device, the mount including:

a swivel hinge; and a folding mechanism comprising counterbalance springs located within the mount and aligned along a longitudinal axis of the mount;

a handle that is coupled to the drivetrain;

a seat that moves along a rail that extends out of the housing;

a pair of foot stretchers, wherein each foot stretcher includes:

a spring-loaded top plate; and a foot strap; and a storage component disposed at least partially between the pair of foot stretchers, wherein the storage component includes a bottle storage area and a charging port.

* * * * *